US005555833A

United States Patent [19]

Schramayr et al.

[11] Patent Number: 5,555,833

[45] Date of Patent: Sep. 17, 1996

[54] SLEEVE INSERTION SYSTEM FOR THE MANUFACTURE OF SHIRTS

[75] Inventors: Ernst Schramayr, Barneveld; Tadeusz A. Olewicz, Clinton, both of N.Y.

[73] Assignee: Jet Sew Technologies, Inc., Bowling Green, Ky.

[21] Appl. No.: 294,095

[22] Filed: Aug. 22, 1994

[51] Int. Cl.[6] ..... D05B 21/00

[52] U.S. Cl. ..... 112/470.31

[58] Field of Search ..... 112/470.06, 470.14, 112/475.04, 475.01, 470.31, 141, 2, 63, 475.09

[56] References Cited

U.S. PATENT DOCUMENTS

| | | | |
|---|---|---|---|
| 4,098,201 | 7/1978 | Adamski, Jr. et al. | 112/2 |
| 4,479,447 | 10/1984 | Rohr | 112/141 |
| 4,685,407 | 8/1987 | Jünemann | 112/63 |
| 4,915,040 | 4/1990 | Sakuma et al. | 112/2 |
| 4,957,054 | 9/1990 | Sakuma et al. | 112/63 |
| 5,058,516 | 10/1991 | Maegawa et al. | 223/112 |
| 5,140,919 | 8/1992 | Bevington | 112/141 |
| 5,349,913 | 9/1994 | Schramayr et al. | 112/63 |
| 5,419,268 | 5/1995 | Flyer et al. | 112/475.09 X |

FOREIGN PATENT DOCUMENTS

| | | |
|---|---|---|
| 6329692 | 10/1986 | Japan . |
| 6145477 | 2/1988 | Japan . |

*Primary Examiner*—Ismael Izaguirre
*Attorney, Agent, or Firm*—Schweitzer Cornman & Gross

[57] ABSTRACT

An apparatus for high production assembly and sewing of tubular sleeve sections to shirt bodies. Tubular sleeve sections are loaded onto sleeve cones, preferably of cylindrical or frusto-conical form. The sleeve cones may be mounted for pivoting movement to facilitate manual loading. A retractable hollow body shell closes over the loaded sleeve cones, and a shirt body is loaded over the body shell and previously loaded sleeve sections. Load fixtures, comprising a body shell and a pair of sleeve cones, are mounted on a carrier, preferably a rotary turret, for advancement from one work station to another, for loading, sewing and unloading operations. For sewing, the load fixtures are bodily detachable from the carrier, and rotated about the axis of the sleeve cones, while the shoulder seams are sewn by a stationary sewing apparatus. Shirt bodies are loaded with an inside-out orientation for the sewing operation. At the unload station, the shirt tails are engaged and drawn off of the load fixtures while simultaneously being turned to an outside-out orientation.

25 Claims, 17 Drawing Sheets

FIG. 12
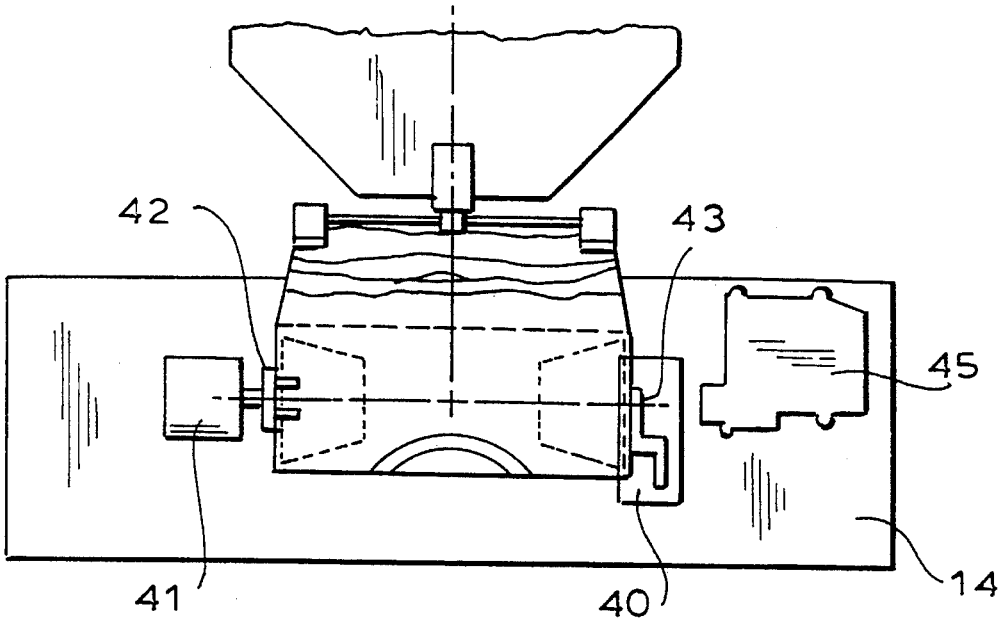
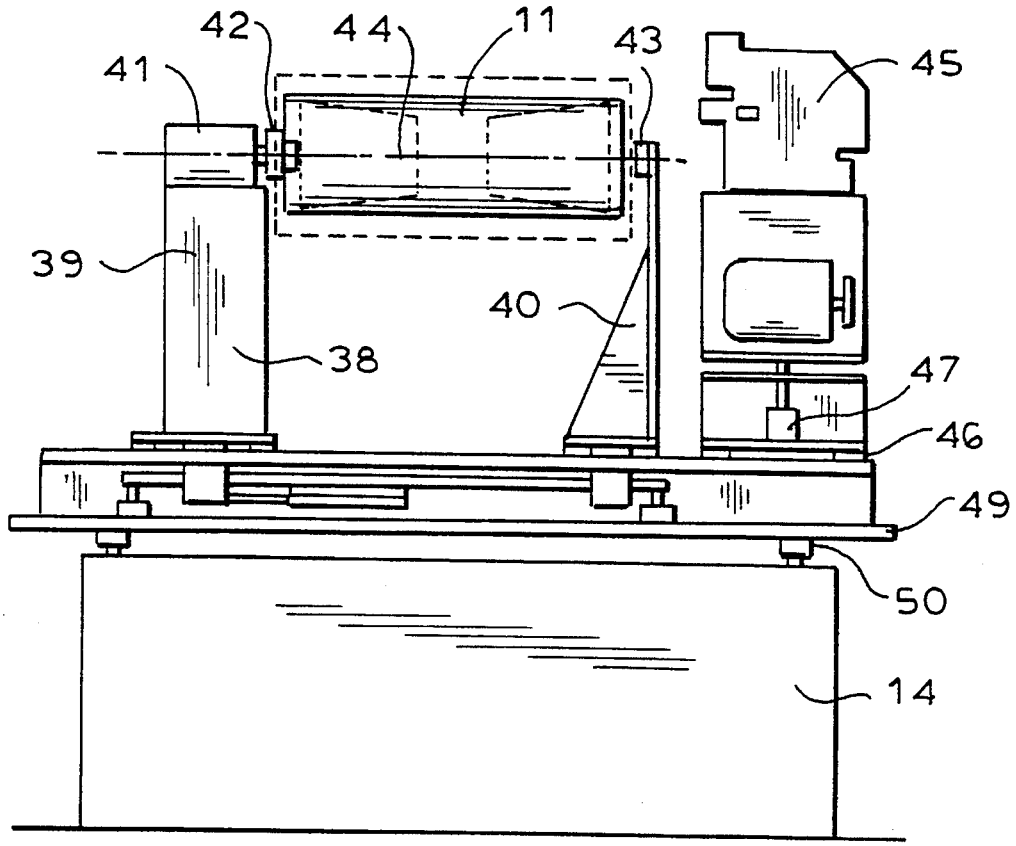
FIG. 13

FIG. 14
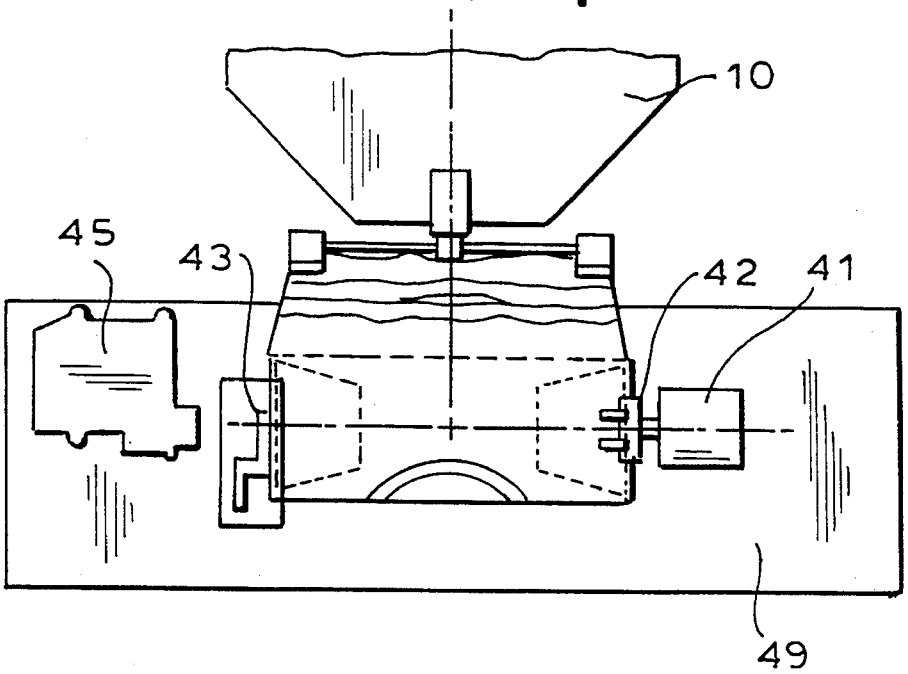
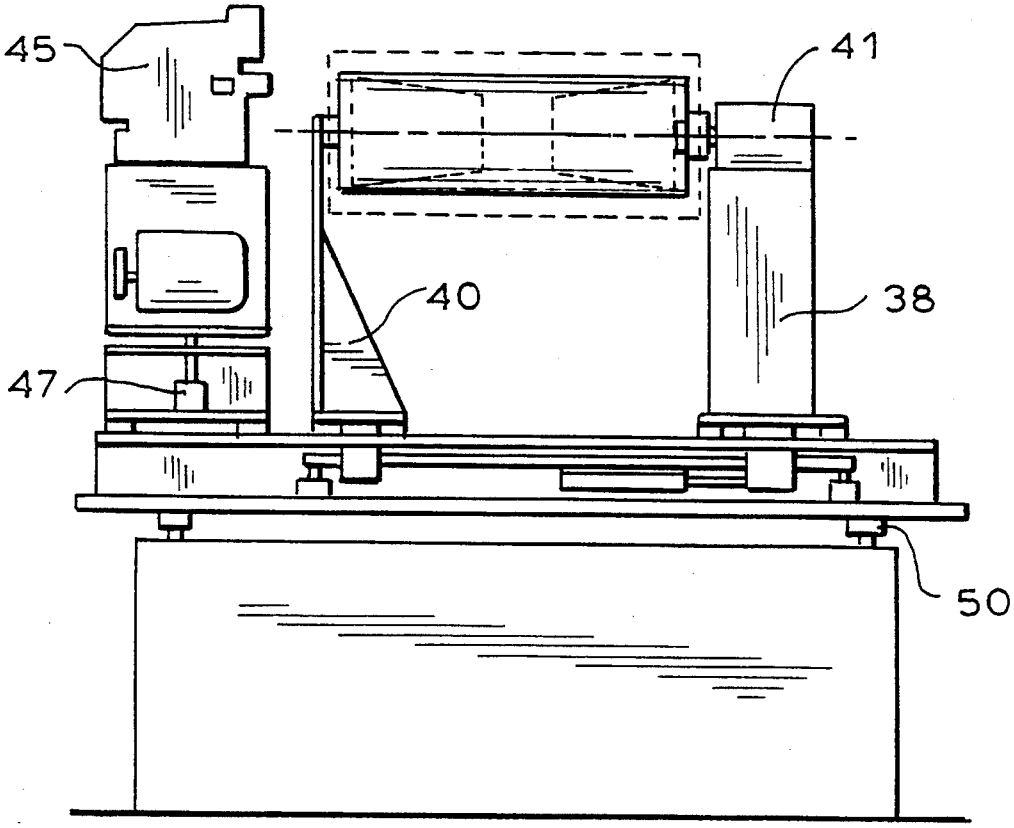
FIG. 15

FIG. 18
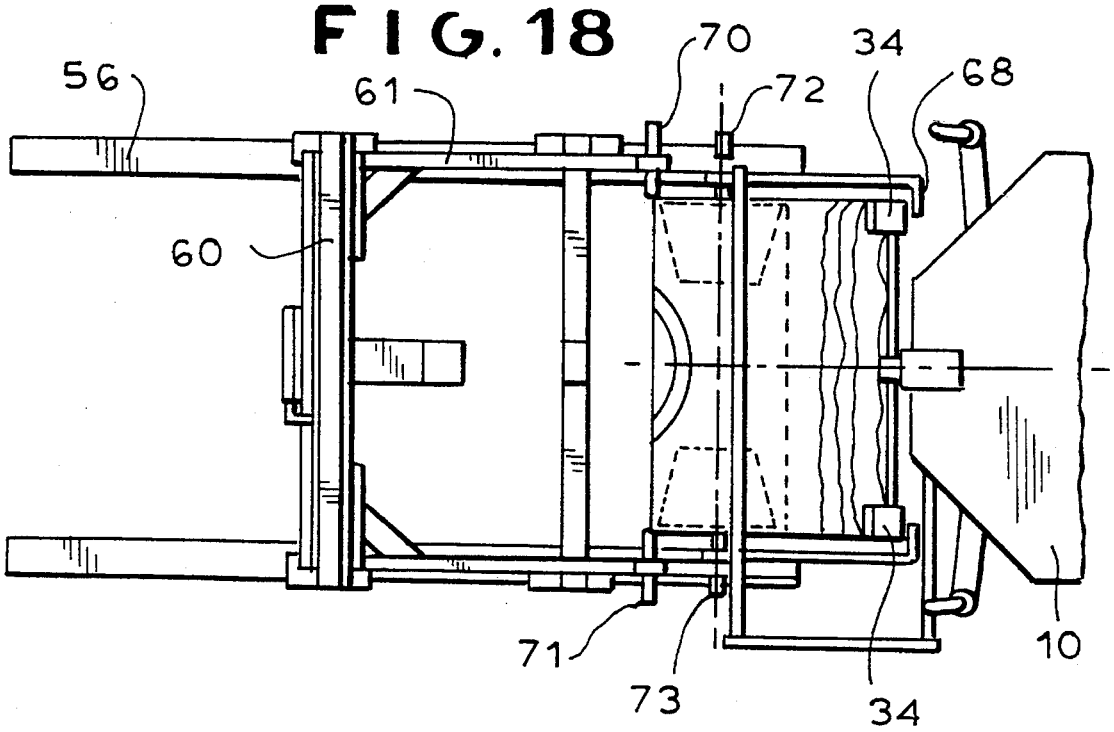
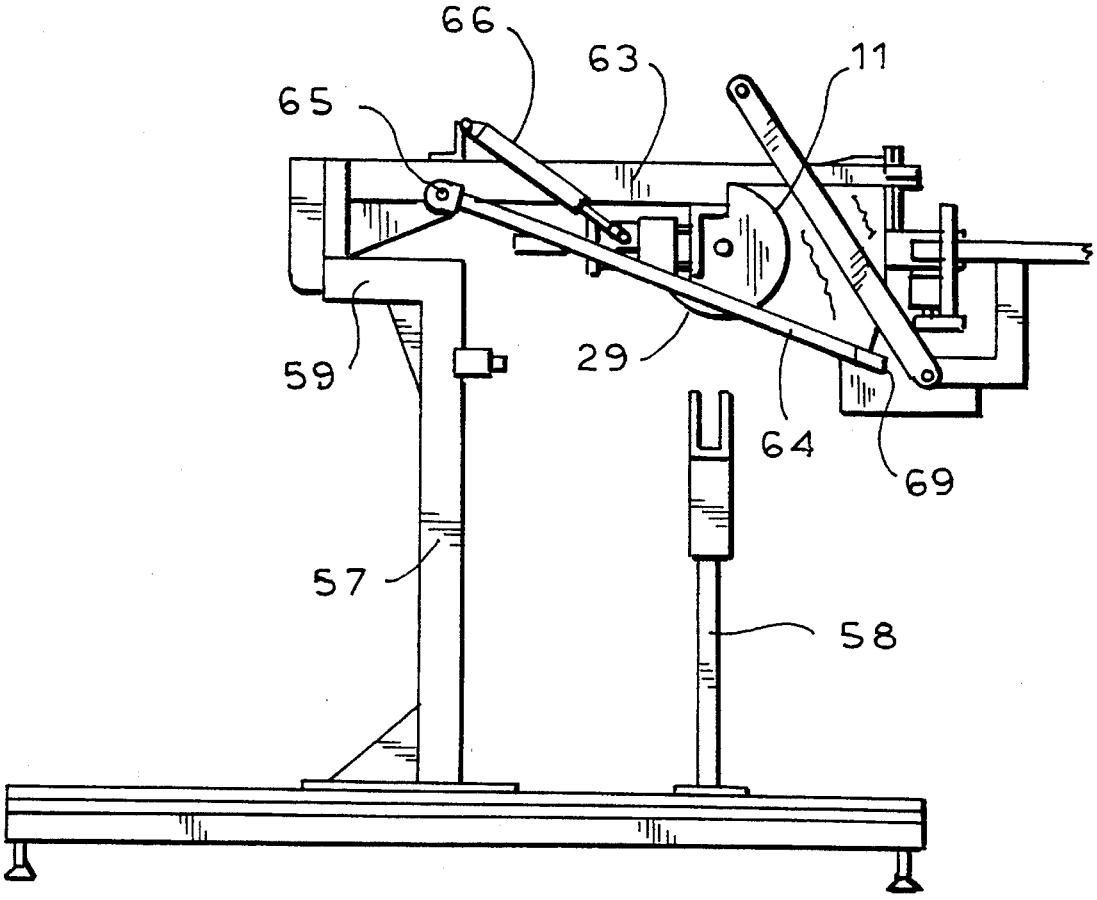
FIG. 19

FIG. 20
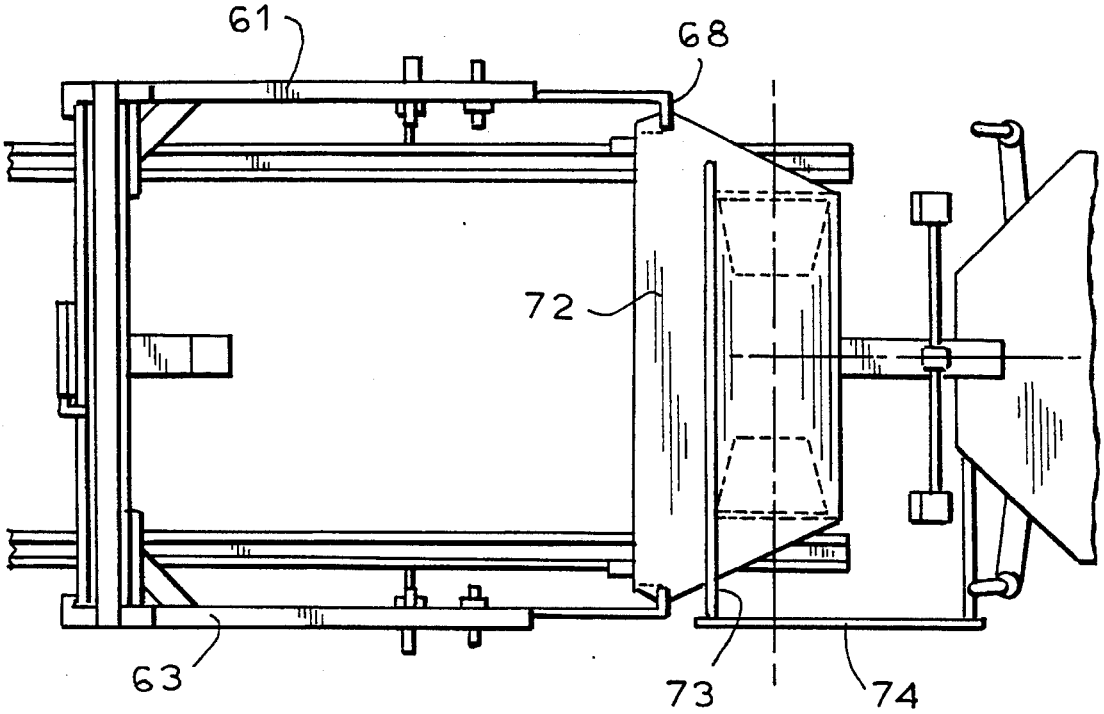
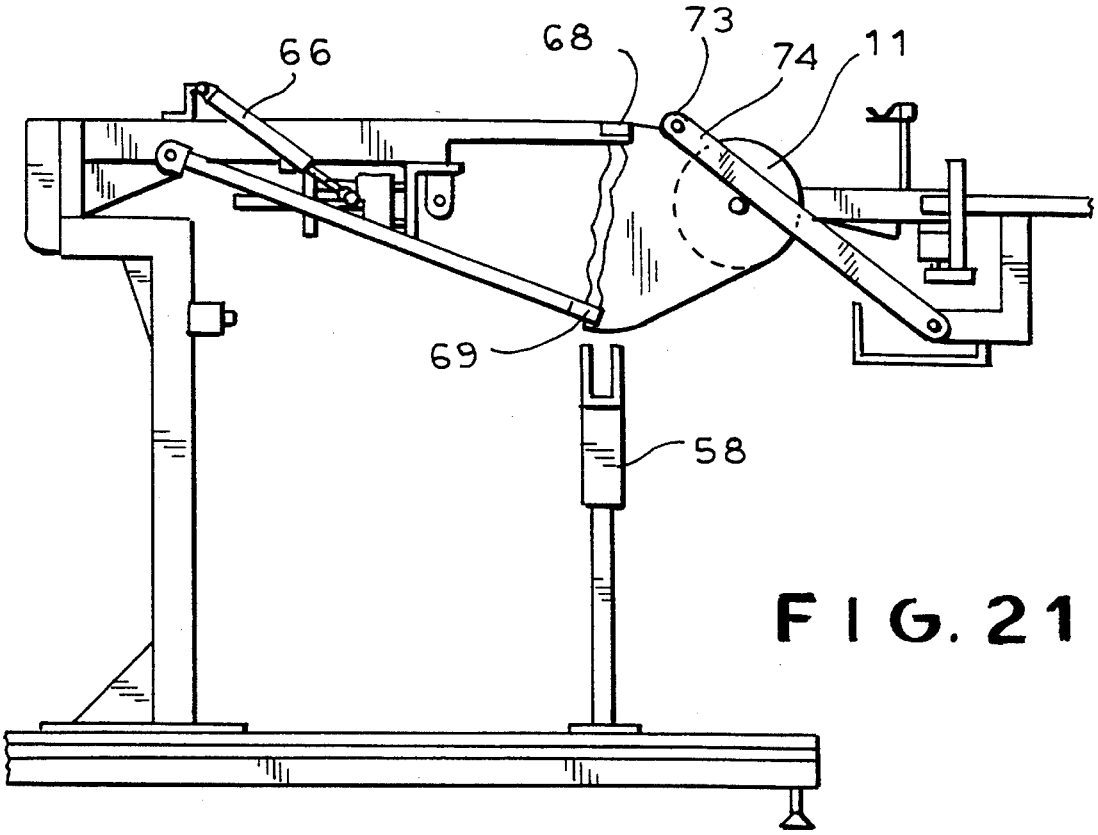
FIG. 21

FIG. 22
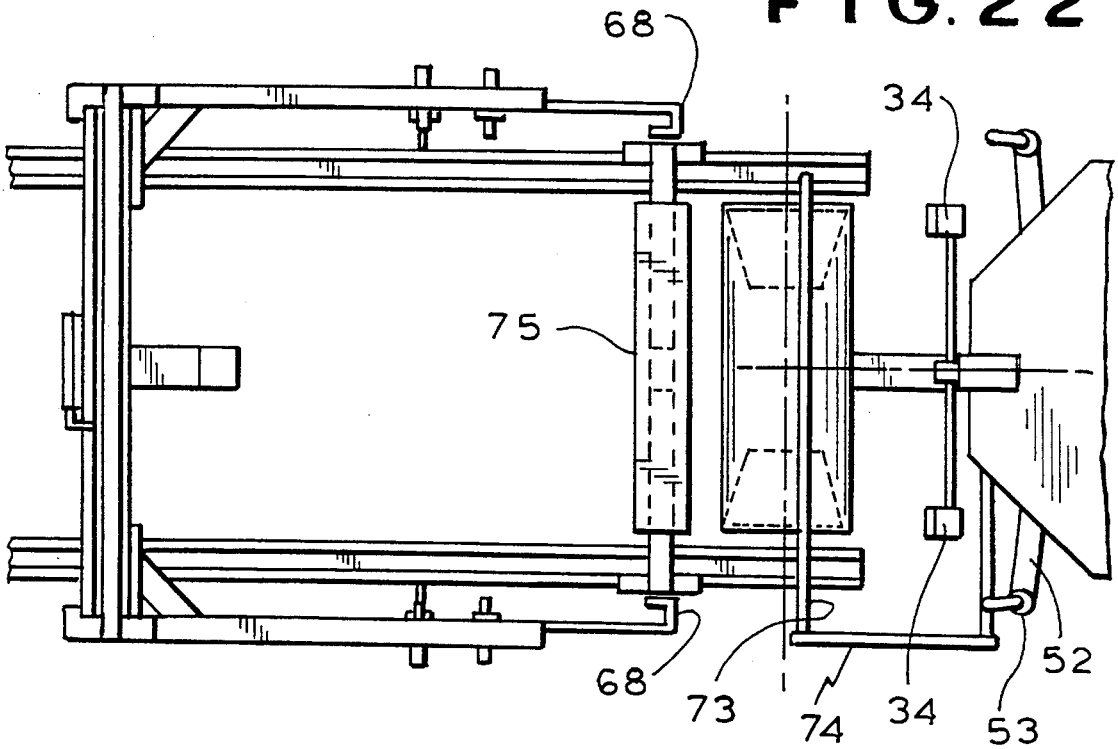
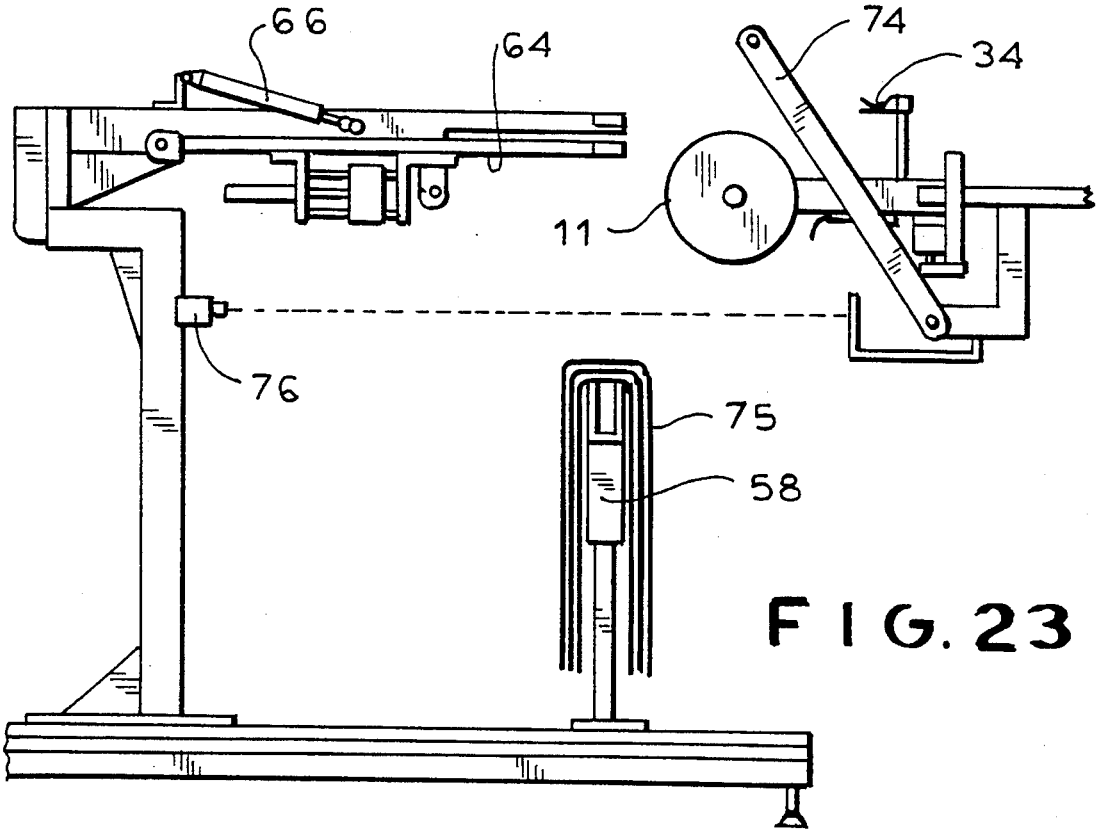
FIG. 23

SLEEVE INSERTION SYSTEM FOR THE MANUFACTURE OF SHIRTS

RELATED APPLICATIONS

This application is related to earlier applications Ser. No. 062,127 now U.S. Pat. No. 5,349,913, filed May 14, 1993 by Ernst Schramayr and Tadeusz Olewicz and Ser. No. 130,358 now U.S. Pat. No. 5,406,900, filed Oct. 1, 1993 by Ernst Schramayr and Tadeusz Olewicz. The disclosures of these applications are incorporated herein by reference.

BACKGROUND AND SUMMARY OF THE INVENTION

This invention relates to the assembly of sleeves to shirt bodies, in the manufacture of shirts, particularly short sleeved pullover shirts and, where appropriate, long sleeve shirts as well.

Pursuant to the teachings of the before mentioned applications, individual sleeve sections are loaded, either automatically or manually, over opposite ends of a body form device. In some instances, especially where the sleeve sections are loaded manually, the sleeve sections are applied first to the body form, and then the shirt body is applied over the body form. The shoulder openings of the shirt body are aligned with the edges of the tubular sleeve sections, and the opposite ends of the body form are presented successively to sewing stations for sewing of the sleeves to the shoulder openings of the shirt body. Where the system is provided with means for automatic loading of sleeve sections, it is advantageous to first apply the shirt body section to the body form, and thereafter automatically load the sleeve sections over the outside of shoulder portions of the shirt body, aligning the edges of the sleeves with the shoulder openings for subsequent sewing operations.

In accordance with a feature of the present invention, provision is made for initially loading tubular sleeve sections over forms, referred to as sleeve cones, which are arranged to be surrounded by a subsequently loaded shirt body. To this end, the apparatus of the invention includes a retractable body form, preferably in the form of a pair of body shell sections. In a retracted or open position, the body shell sections expose the sleeve cones to accommodate sleeve-loading operations. Thereafter, the body shell sections close over the sleeve cones and the loaded sleeve sections, allowing a shirt body to be loaded over the outside of the sleeve sections.

To particular advantage, the retractable body shell sections are formed with axially retractable end portions which, during the loading of a shirt body section over the closed body shell, extend axially outward to completely conceal and protect the ends of the previously loaded sleeve sections. After the shirt body section is properly positioned over the body shell, the end sections of the body shell are retracted axially to provide access to end margins of the sleeve sections during subsequent sewing operations.

In one advantageous form of the present invention, a load fixture is provided which includes movable sleeve cones, which can be reoriented relative to the balance of the body form, so that both shoulder cones are simultaneously or separately presented end-on to the machine operator, making them more accessible for manual loading. This renders the sleeve loading operations more convenient and expeditious. After loading, the sleeves are reoriented to normal, axially spaced and opposed positions. The retractable body shells are then closed over the sleeve cones to accommodate commencement of loading of a shirt body.

Pursuant to another feature of the invention, an entire load fixture, comprising the body form mechanism and sleeve cones, is detachably connected to a carrier means, preferably a central turret, by which the load fixtures may be advanced from station to station for the performance of different operations. In an advantageous embodiment of the invention, there are four work stations: a loading station, a first sleeve sewing station, a second sleeve sewing station, and an unloading/stacking station. A turret is thus arranged for 90° indexing movements. After loading of a load fixture with sleeve sections and a shirt body section, the turret is indexed 90°, presenting the loaded fixture to the first sewing station. At the first sewing station, the load fixture is first gripped at opposite "shoulders" and then detached from the indexing turret. The entire load fixture is then rotated about the axis of the "shoulders" while the sewing of the first shoulder seam takes place. The fixture is then reattached to the indexing turret, which [then] indexes through another 90° to present the loaded fixture to the second sewing station. At the second sewing station, the load fixture is again detached from the turret and rotated about its "shoulder" axis while a second sewing machine sews the second shoulder seam of the shirt. After completion of this operation, the load fixture is reattached to the indexing turret and indexed another 90° to the unloading/stacking station. At that station, the shirt body, with sewn-on sleeves, is gripped and removed from the body form and deposited on a stacking bar. A preferred system is provided with four index positions, so that operations are being performed simultaneously at all four work stations after each indexing movement of the turret.

For a more complete understanding of the above and other features and advantages of the invention, reference should be made to the following detailed description of a preferred embodiment of the invention and to the accompanying drawings.

DESCRIPTION OF THE DRAWINGS

FIGS. 12 and 13 are fragmentary top and elevational views, respectively, illustrating features of a first sewing station of the system.

FIGS. 14 and 15 are views, corresponding to those of FIGS. 12 and 13, showing a second sewing station of the system.

FIGS. 18–23 are three sets of top plan and side elevational views of the unloading mechanism of FIGS. 16, 17, illustrating the mechanisms in successive operating positions assumed during an unloading operation.

DESCRIPTION OF PREFERRED EMBODIMENTS

Figure 1:
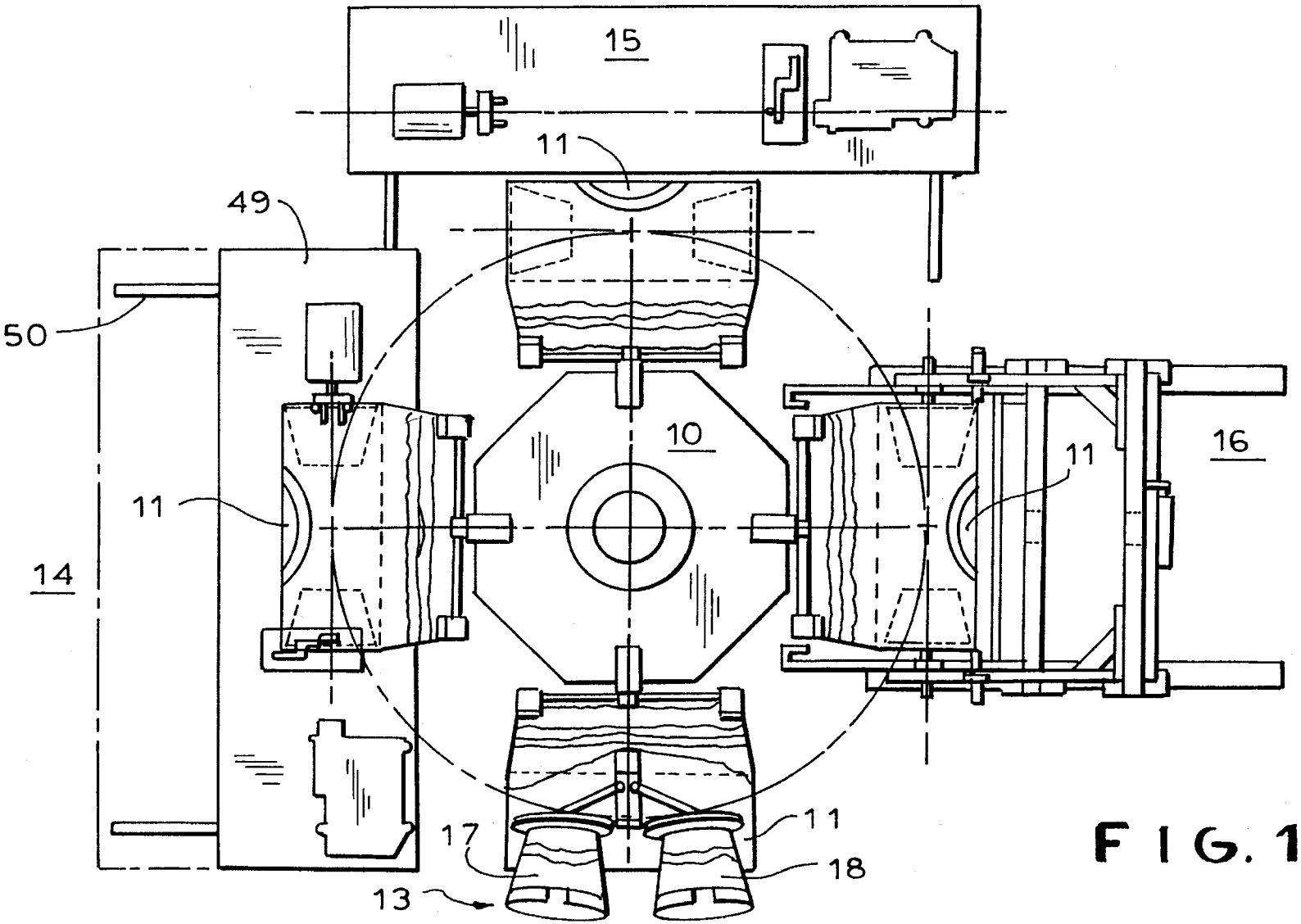
FIG. 1 is a top plan view representing a four-station turret apparatus according to the principles of the invention.
Figure 3:
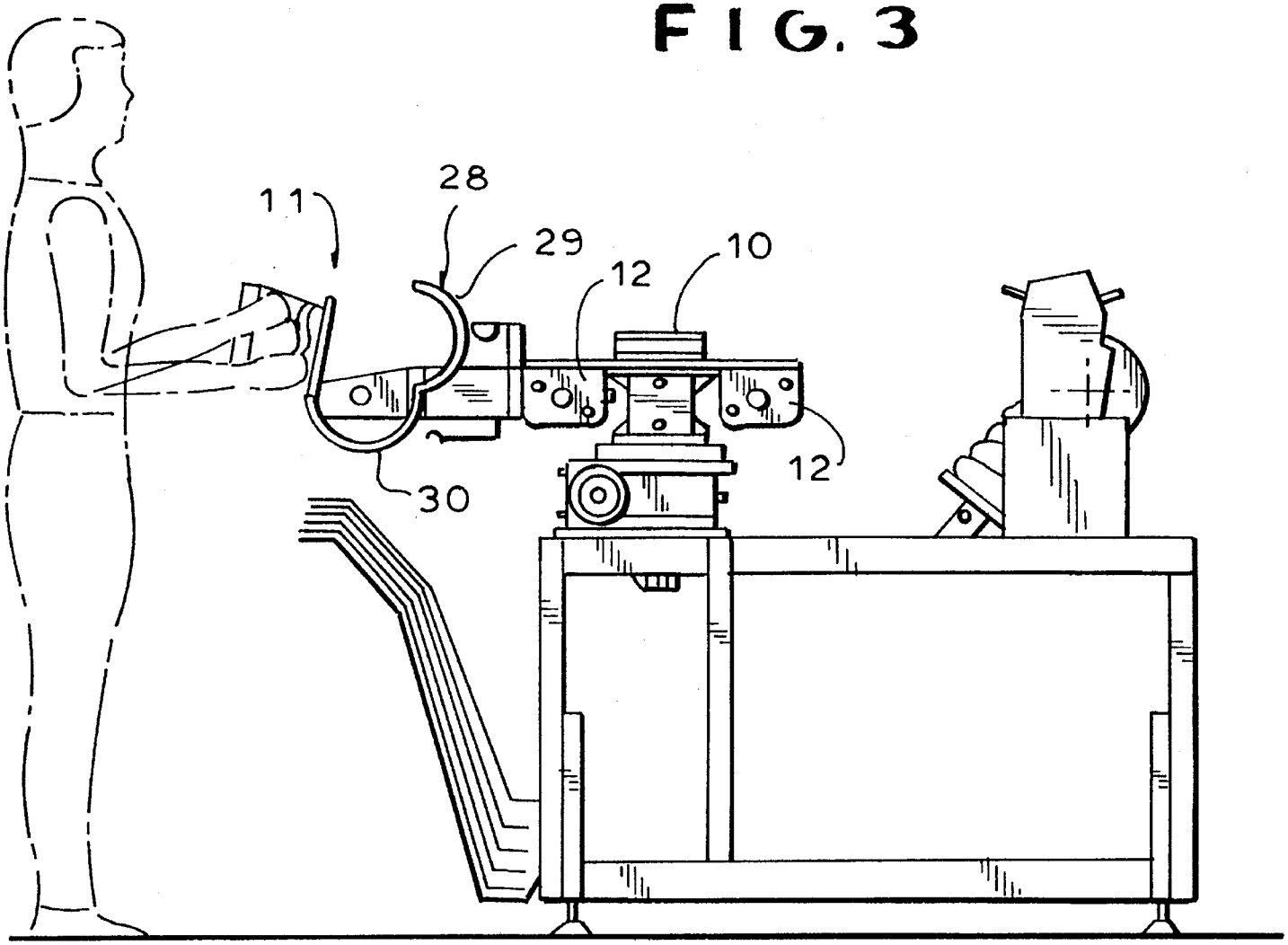
FIG. 3 is a side elevational view illustrating features of the sleeve-loading station of the system.

Referring now to the drawings, and initially to FIG. 1, the reference numeral 10 designates an indexable turret mechanism which, in the illustrated apparatus, is arranged with four working positions and is adapted to be indexed in 90° increments. At each of four working positions, the turret carries a load fixture 11, to be described in greater detail. These load fixtures are removably attached to the turret by releasable coupling devices 12 (FIG. 3) mounted on the turret.

Figure 2:
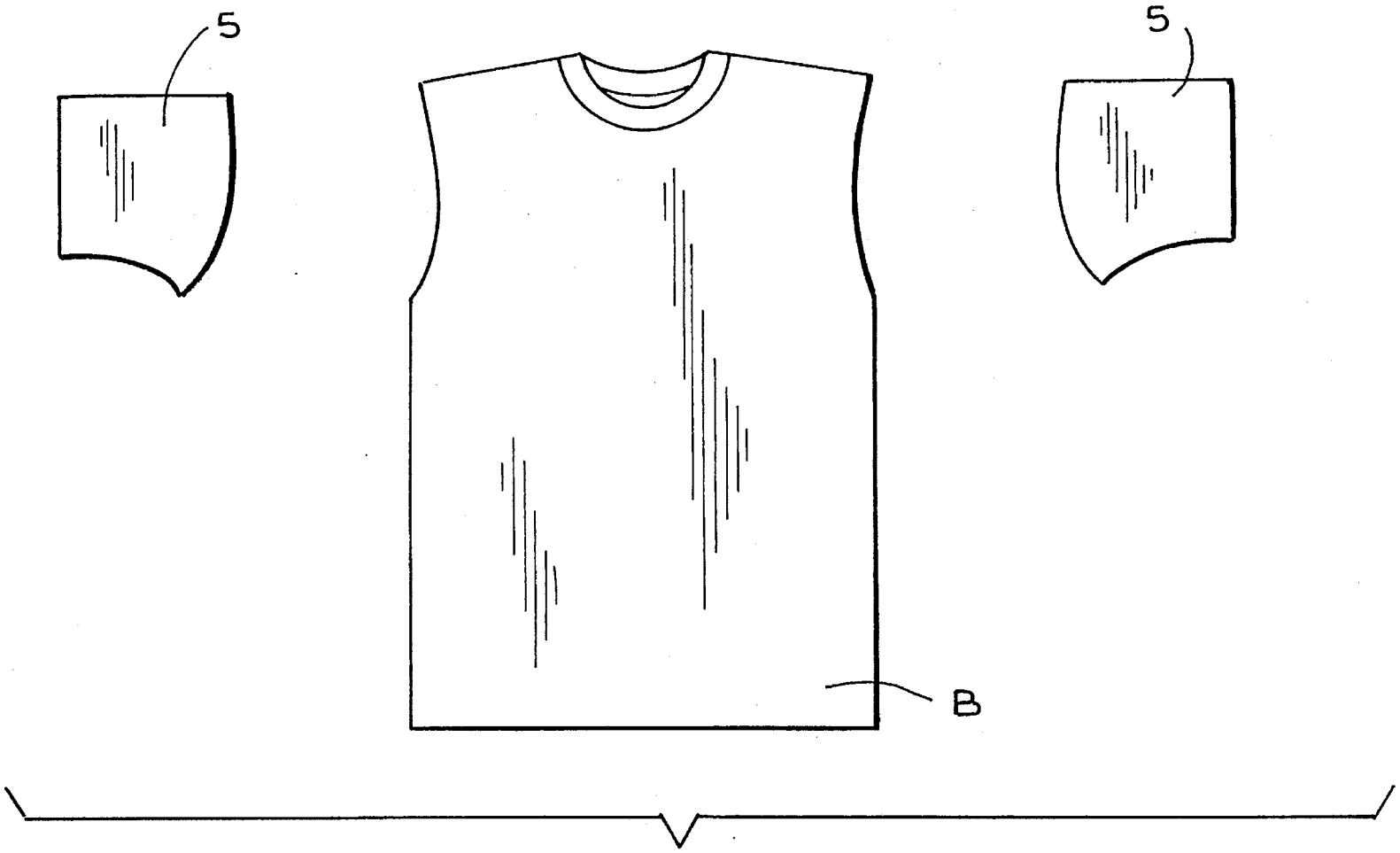
FIG. 2 is an exploded view illustrating the individual components of a shirt, to be assembled and sewn using the apparatus of the invention.

In the illustrated system, the apparatus is arranged with four work stations 13–16 which are, respectively, a load station, a first sewing station, a second sewing station and an unload station. In general, an operator stands at the load station 13 and applies sleeve sections and a shirt body section B (FIG. 2) to the load fixture 11. The turret then indexes to the first sewing station 14 where one sleeve is sewn to the shirt body. On the next index of the turret, the partially sewn shirt is advanced to the second sewing station 15, where the second sleeve is sewn to the shirt body. The completed shirt then advances to the unload station 16, where it is removed from the load fixture and stacked with previously finished goods.

Figure 6:
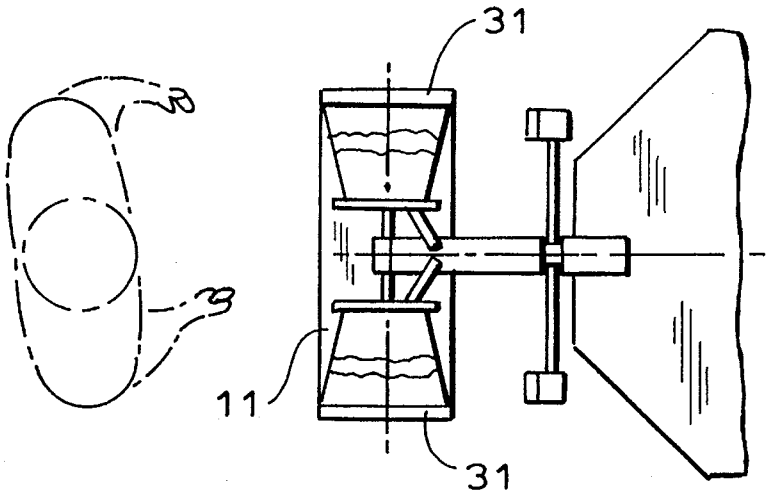
FIGS. 5 and 6 are fragmentary top plan views showing a preferred form of sleeve cone presented frontwise to the operator (FIG. 5) for convenient loading and subsequently (FIG. 6) rotated to opposed, axially aligned positions for further processing.
Figure 5:
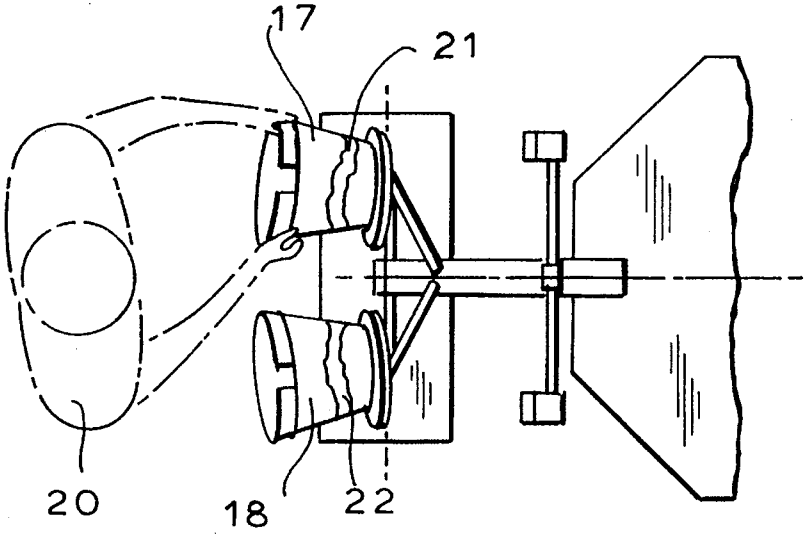

The several load fixtures 11 are of the same construction, and in one preferred embodiment each includes pivotable sleeve cones 17, 18 mounted on a central support arm 19. The sleeve cones, which desirably are of frusto-conical configuration, are mounted for orientation in one of two positions, as shown in FIGS. 5 and 6. For convenient loading of tubular sleeve sections, the sleeve cones 17, 18 are initially rotated to a position in which their respective axes are oriented more or less radially with respect to the turret 10, so that the sleeve cones 17, 18 are presented end-on to the operator 20, as shown in FIG. 5. The operator can then conveniently pick up tubular sleeve sections from a nearby supply (not shown) and apply them over the respective sleeve cones. In the illustrated system, the sleeve sections, represented at 21, 22 in FIG. 5, are applied "right-side-out" over the sleeve cones. The edges to be sewn of the sleeve sections are aligned approximately with a predetermined edge or mark on the sleeve cones. As soon as the operator has completed the sleeve loading operations, the load fixture is actuated to reorient the sleeve cones to the position of FIG. 6, in which the cones are positioned in axial alignment at opposite ends of the load fixture 11.

Figure 8:
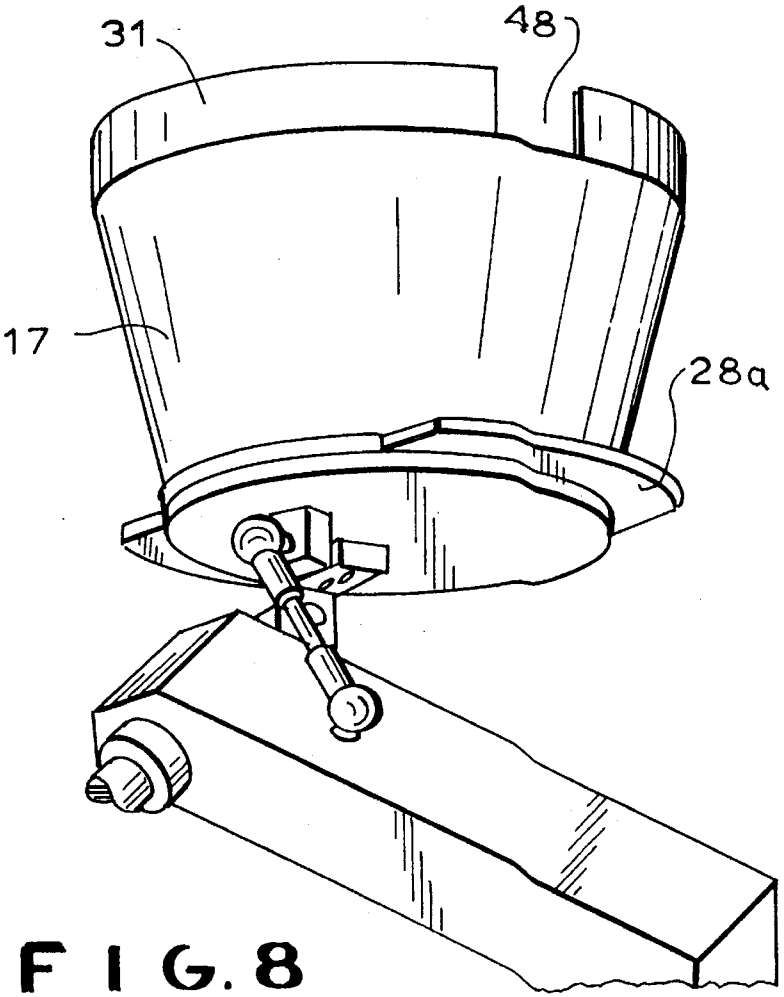
FIGS. 7, 8 and 9 are sequential fragmentary perspective views showing, respectively, a pivotable sleeve cone in a forwardly presented position, a partially rotated position and an axially aligned position.
Figure 7:
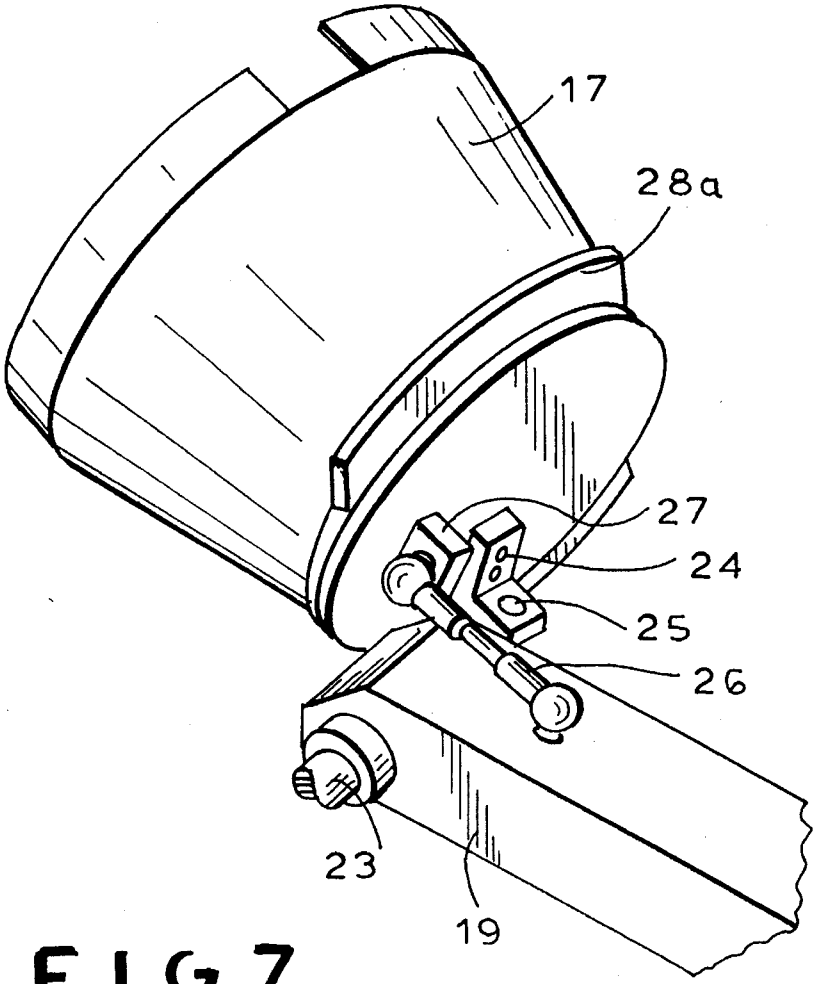
Figure 9:
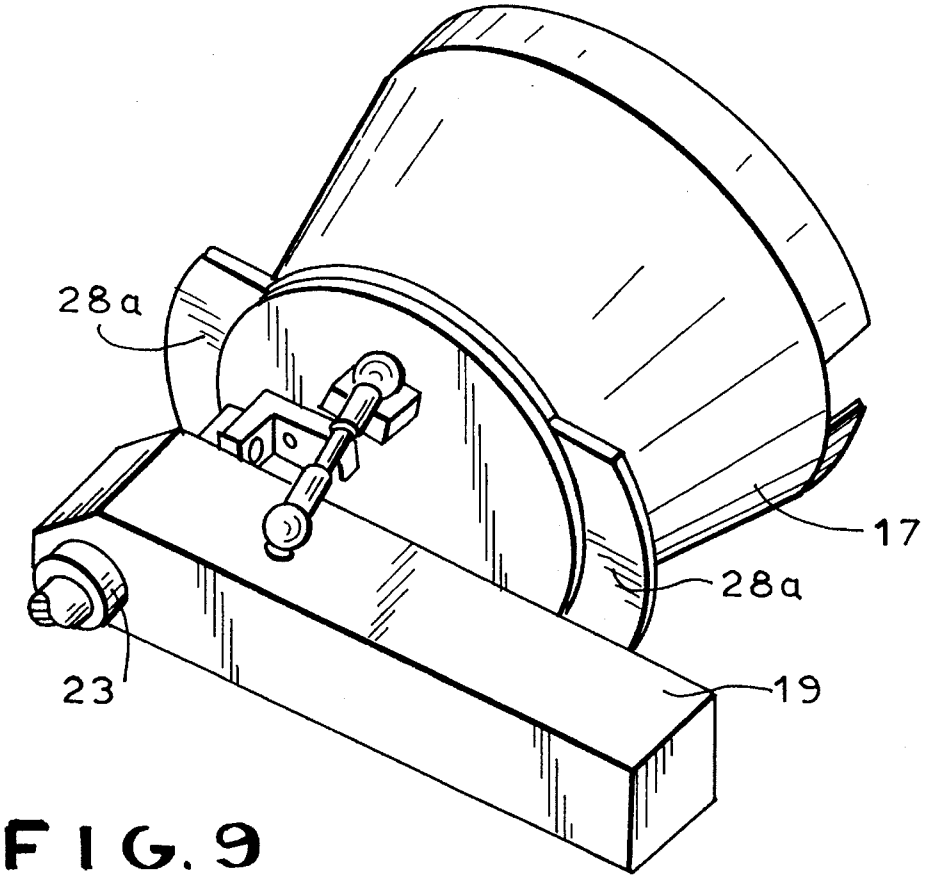

With reference to FIGS. 7–9, there is shown an illustrative mechanism for mounting and reorienting of the pivotable sleeve cones 17, 18. A central support arm 19 carries a rotatable control shaft 23 mounting at each end an L-shaped bracket 24. The bracket 24 is secured to the control shaft 23 by a pivot pin 25 set at right angles to the axis of the control shaft 23. The arrangement is such that a sleeve cone 17 can be pivoted, relative to the control shaft 23, from a load position, shown in FIG. 7, in which the axis of the sleeve cone is more or less at right angles to the control shaft 23, to a working position, shown in FIG. 9, in which the axis of the sleeve cone 17 is parallel to the axis of the control shaft. A fixed, pivotable connecting link 26 is connected for universal pivoting at one end with the support arm 19 and at the other end with a lug 27 secured to the sleeve cone. The arrangement of the control shaft 23, the L-shaped mounting bracket 24 and the connecting link 26 is such that, by merely rotating the control shaft 23, the sleeve cone 17 can be manipulated from the load position shown in FIG. 7 to the working position shown in FIG. 9.

It is also contemplated that the respective sleeve cones may, if desired, be mounted in fixed positions, generally in the orientations shown in FIG. 6. This provides a somewhat simplified apparatus, at the expense of less convenience in the sleeve loading operations.

As shown in FIGS. 5–9, the sleeve cones 17, 18 advantageously include retaining flanges **28*a* extending outward from their inner or small diameter ends. When a tubular sleeve section is loaded onto a sleeve cone, the end of the sleeve section is stopped by the flange 28*a***, and excess sleeve material is gathered on the sleeve cone near the flange.

As shown in FIGS. 3–6, the load fixture 11 includes a tubular body form 28, comprised of semi-cylindrical body shells 29, 30. Where pivotable sleeve cones are employed, the lower body shell 30 may be fixed to the support arm 19, while the upper body shell 29 is pivoted along its back edge and is movable to an open position, shown in FIG. 3, to accommodate the sleeve loading operation. Where fixed sleeve cones are employed, it may be advantageous to provide for pivoting of both the upper and lower body shells 29, 30 to provide free access to the sleeve cones for loading operations. Once the sleeve sections are loaded (and the sleeve cones, if pivoted for loading, returned to their working positions, shown in FIG. 6) the body shells are closed. When the body shells are closed, the sleeve cones are fully enclosed within the hollow interior of the body form.

Figure 10:
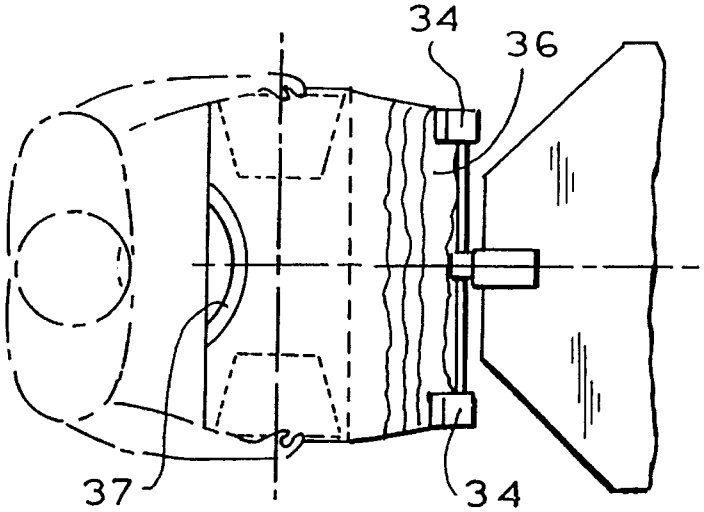
FIGS. 10 and 11 are fragmentary top and side elevational views, respectively, showing the manner of loading a shirt body onto a body form at the load station of the system.
Figure 11:
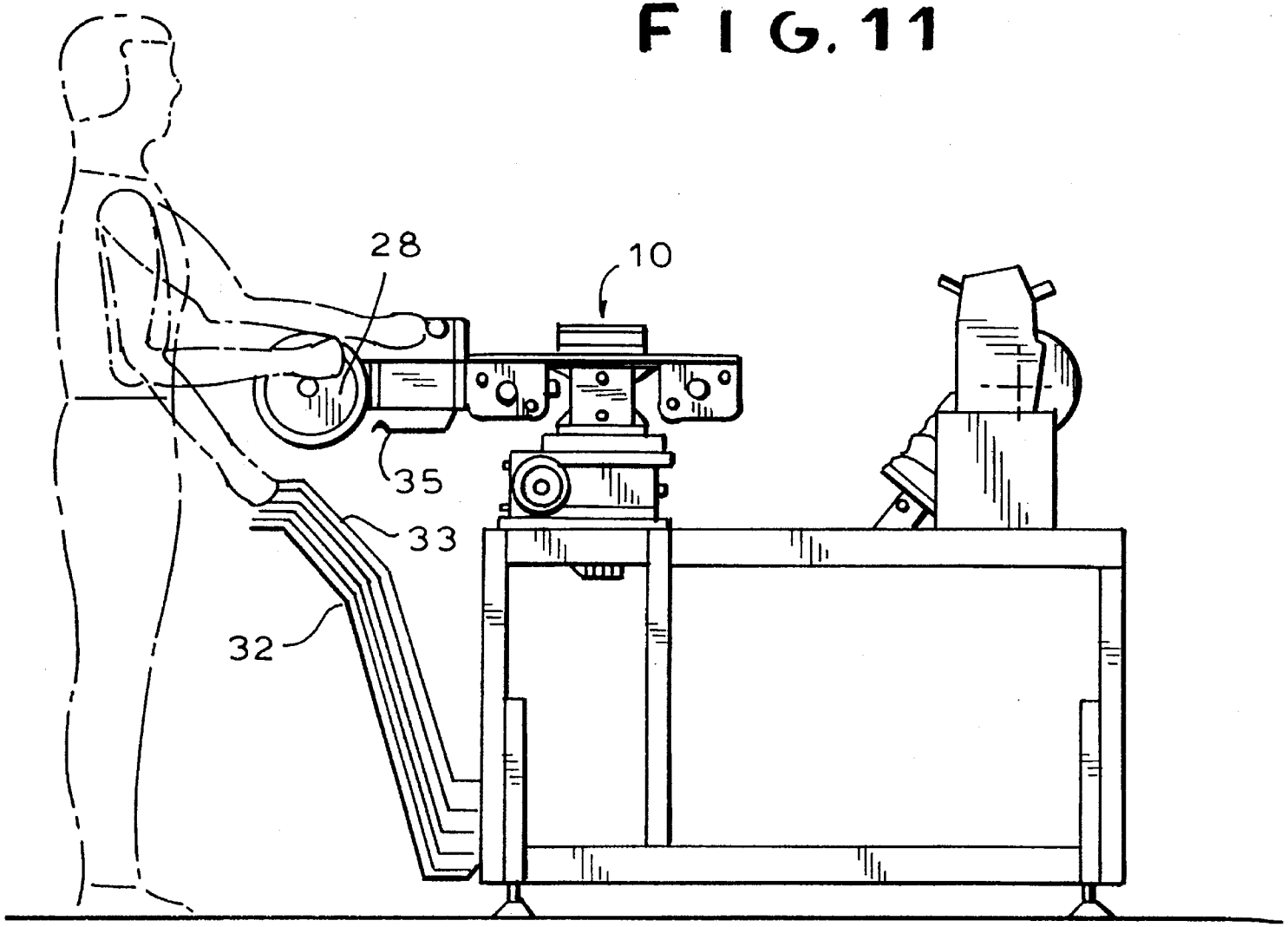

With reference now to FIGS. 10 and 11, the equipment is now ready for loading of a shirt body over the body form. Desirably, a load rack 32 is provided at the load station and contains a supply of shirt bodies 33, oriented "inside-out". The operator grips a shirt body, tail first, and applies it over the closed body form 28 as generally shown in FIG. 10. At the back of the load fixture 11, there are provided upper and lower passive clips 34, 35 respectively. The upper clips 34, which are spaced apart to be substantially equal to the width of the body form and sleeve cone combination, are arranged to receive and retain upper portions of the shirt tail 36. The lower clip 35 engages a central lower portion of the shirt tail. The operator, in loading the shirt body, approximately centers the neck opening 37 and approximately aligns the edges of the shoulder openings of the shirt body with corresponding edges of the sleeve sections previously loaded onto the sleeve cones.

In a preferred form of the invention, the body shells 29, 30 are formed with axially retractable sleeve shields, which enable the previously loaded tubular sleeve sections to be completely covered and protected during loading and alignment of a shirt body section. Later, when a sewing operation is about to commence, the sleeve shields are retracted, exposing the shoulder margins of the sleeve section for engagement by the sewing machine. Details of the lower body shell 30 are illustrated in FIG. 4, it being understood that the upper and lower body shell may be generally of the same construction.

Figure 4:
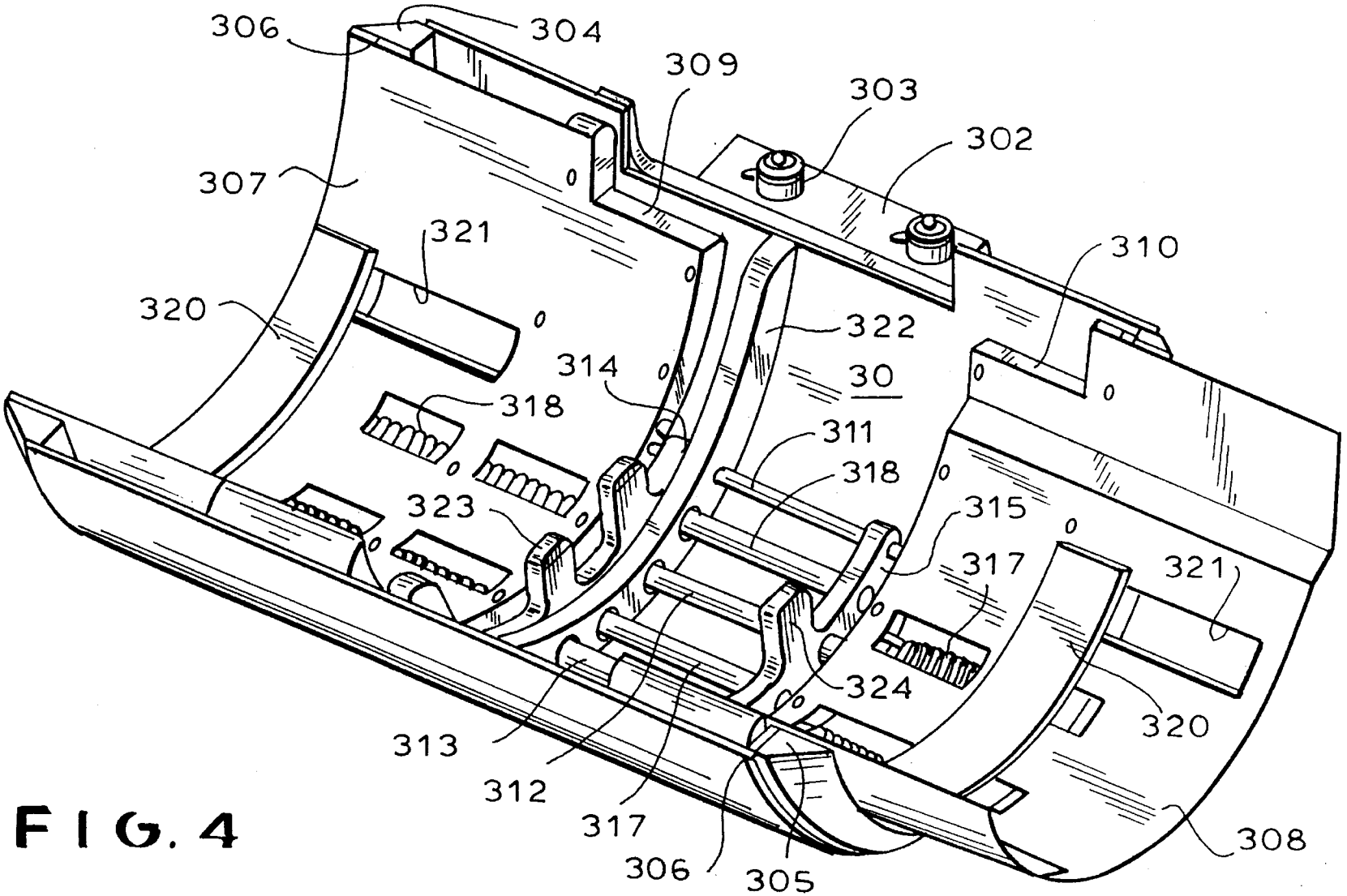
FIG. 4 is a perspective view of a preferred form of body shell member used in the apparatus of the invention.

With reference now to FIG. 4, the reference numeral 301 represents the primary body shell member, which is substantially semi-cylindrical in form, being provided at one side with a mounting bracket 302 carrying locating pins 303. At each end of the primary shell 301 are mounted semicircular guides 304, 305. These are fixed to the inside of the shell and are provided on the inside with generally semicylindrical guide surfaces 306 generally concentric with the shell 301 and spaced radially inward therefrom. The supports 304, 305 guide and support generally semicylindrical sleeve shields 307, 308, advantageously formed of thin sheet metal. At their inner ends, the sleeve shields 307, 308 are fixed to rigid, semicylindrical carriers 309, 310 guided for axial sliding movement relative to the main shell 301, by means of a plurality of guide rods 311–313. Actuator plates 314, 315 are attached to the respective carriers 309, 310 and are guided for sliding movement by rods 316, 317. Extensible springs 318 act between the supports 304, 305 and the respective carriers 309, 310, to urge the carriers and sleeve shields 307, 308 carried thereby in extending directions. In this respect, FIG. 4 illustrates one of the shields 307 in a retracted position and the other shield 308 in an extended position.

In the form of the invention illustrated in FIG. 4, the sleeve shields 307, 308 are held in place and guided for axial sliding movement by means of arcuate retainers 320 supported at opposite ends by guide blocks (not shown), received in elongated guide slots 321 formed in the respective shields 307, 308.

The respective actuator plates 314, 315, which lie on opposite sides of a central shell support 322 are provided with radially extending tongues 323, 324 which are engageable by a suitable internal or external mechanism (not shown) for displacement of the sleeve shields in a retracting direction, during sewing operations. For this purpose, it may be appropriate to provide a suitable probe (not shown) in conjunction with the sewing mechanism, whereby as the sewing machine approaches the load fixture to execute the sewing operation, the sleeve shield associated with the end to be sewn is automatically retracted while the sewing machine is present.

After the shirt body has been loaded on the body form, and the edges of the shoulder opening adjusted and aligned, the turret 10 can be indexed 90°, simultaneously advancing the just-loaded shirt body and sleeve elements to the first sewing station 14, and bringing an empty load fixture 11 to the load station 13. At the sewing station 14, the body form is engaged at opposite ends by a sewing "lathe" generally designated by the numeral 38. The sewing lathe includes movable supports 39, 40 (FIG. 13) which are adjustably movable toward and away from each other, and toward and away from the center of the turret. The support 39 mounts a drive motor 41 and driving center 42. The opposite support 40 carries a dead center 43. When the loaded fixture arrives at the sewing station 14, the supports are moved to engage the load fixture at opposite ends, along the axis 44 of the sleeve cones. Once the load fixture has been thus engaged, the entire load fixture is released from its coupling device 12, so that the load fixture is supported exclusively by the sewing lathe 38. At this time, the lathe retracts radially outward a short distance so that the load fixture 11 is clear of the turret 10.

With the load fixture 11 now supported exclusively by the lathe supports 42, 43, a sewing apparatus 45 advances toward the end of the load fixture supported by the dead center 43. The sewing apparatus 45 is movable axially along a mounting platform 46, in order to approach and retract from the sewing position, and it is also vertically adjustable by means of an adjustable support 47, in order to properly align the sewing head with the diameter of the sleeve cone. In this respect, it is contemplated that the sewing apparatus 45 will be initially located in a vertically retracted position and will be elevated at sewing time toward the cylindrical projection of the sleeve cone. By employing a suitable optical detector (not shown) the sewing head will automatically detect the edge of the sleeve cone, so that cones of different diameter may be readily and automatically accommodated. Desirably, the cylindrical portion of the sleeve cone is provided with a sewing notch 48 in which sewing takes place. The entire cylindrical flange 31 of the sleeve cone is arranged to rotate relative to the body of the cone during the sewing operation, so that all sewing takes place in the notch 48.

When the sewing apparatus 45 is properly positioned at the notch 48 and ready for sewing, the lathe motor 41 is actuated and rotated at a speed which is synchronized with the operation of the sewing machine and the diameter of the sleeve cone. Thus, the entire load fixture 11 is bodily rotated by the sewing lathe and the sewing apparatus 45 itself remains stationary.

Preferably, the sewing apparatus includes devices, not shown but in themselves well known, for manipulating and positioning the fabric edges, as the edges progressively advance toward the sewing position, to provide optimum uniformity in the sewing of the shoulder seam.

During the sewing operations, the sleeve shields 307 or 308 associated with the end being sewn are held in a retracted position to provide access to the shoulder edge of the sleeve section for sewing to the shirt body.

After completion of sewing of the first shoulder seam, the sewing apparatus 45 is retracted axially from the body form, and the entire lathe platform 49 is advanced on its tracks 50 to present the load fixture to the coupling device 12, for reattachment to the turret 10. After the reattachment has been completed, the sewing platform 49 is retracted sufficiently to allow the load fixture to be indexed to the next position. When the operator at the load station 13 has completed the loading of the empty load fixture, the turret 10 can be indexed, advancing the partly sewn shirt to the second sewing station 15.

The second sewing station is illustrated in FIGS. 14 and 15 and is substantially a mirror image of the first sewing station shown in FIGS. 12 and 13. Accordingly, the same reference numerals will be employed to designate corresponding parts.

After indexing of the partially sewn shirt to the second sewing station, the sewing platform 49 advances toward the turret 10 to a position enabling the load fixture to be engaged at opposite ends by the sewing "lathe". Once the fixture is engaged by the driving center 42 and the dead center 43, the load fixture is again disengaged from the coupling device 12, by which it is attached to the turret, and the sewing platform 49 retracts sufficiently on its rails 50 to permit rotation of the entire body fixture about the axis of the sleeve cones. The sewing operation proceeds in the same manner as described in connection with the first sewing station, with the sewing machine advancing axially toward the unsewn end of the body fixture and adjusting radially as necessary to locate the fabric edges to be sewn. The sewing head engages the fabric at the notch 48 in the rotary cylindrical flange of the sleeve cone, and the sewing operation proceeds as the load fixture is rotated controllably at a rate to match the stitching operations of the sewing machine.

When the second sewing operation has been completed, the sewing apparatus is retracted away from the load fixture, the sewing platform 49 is advanced toward the turret 10, in order to reattach the load fixture to its coupling device 12. When the load fixture has been reattached, the lathe elements 42, 43 retract axially from the load fixture, and the sewing platform 49 is retracted sufficiently to allow the turret 10 to index the now completed shirt to the unload station 16.

During the sewing operations, while the load fixture is being rotated about the axis of the sleeve cones, it is desirable to control the loose body fabric of the shirt, gathered between the cylindrical body shell 28 and the clips 34, 35. To this end, the support arm 19 pivotally mounts a pair of clamping arms 51, 52 (see FIGS. 16 and 17), each carrying an arcuately shaped clamping pad 53. The clamping arms 52 are carried by rotary actuator means 54 mounted on the central support arm 19. The actuator means are arranged to swing the clamping arms 52 to the clamping position, as shown in FIG. 17, after completion of the loading operations at the load station 13. The arms are held in this position during operations at the first and second sewing stations 14, 15. When a load fixture, with a completely sewn shirt body thereon, is advanced to the unload station 16, the clamping arms 51, 52 are rotated to retracted positions, shown in FIG. 16. This frees the shirt body for the unloading operations to follow.

At the unloading station, there is provided a platform 55 comprised of spaced rails 56 mounting an unload mechanism 57 for controlled movement toward and away from a load fixture indexed to the unload position. Also mounted on the rails 56 for adjustable movement is a rack 58 for receiving finished goods. The rack preferably is adjustable both vertically and horizontally for optimum positioning relative to the other mechanisms.

In the illustrated apparatus, the unload mechanism 57 includes a support 59 mounting a telescopic cross bar 60. At each end, the telescoping cross bar 60 carries inwardly extending sets of extracting arms 61, 62. Each of the sets of extractor arms includes a fixed upper arm 63 and a movable lower arm 64 pivoted at 65 to an outer portion of the fixed arm 63. Actuator means 66 is provided for pivoting the movable extracting arms 64 from an initial, generally horizontal closed position, shown in FIG. 17, to a downwardly inclined or open position, shown in FIG. 19.

At the outer ends of each of the extracting arms 63, 64 is a hook 68 (for the upper arms) or 69 (for the lower arms). These hooks, as will be further described, are adapted to engage the open tail of the completed shirt body for simultaneously extracting the shirt from the load fixture and reversing the orientation of the shirt to an "outside-out" orientation.

Figure 16:
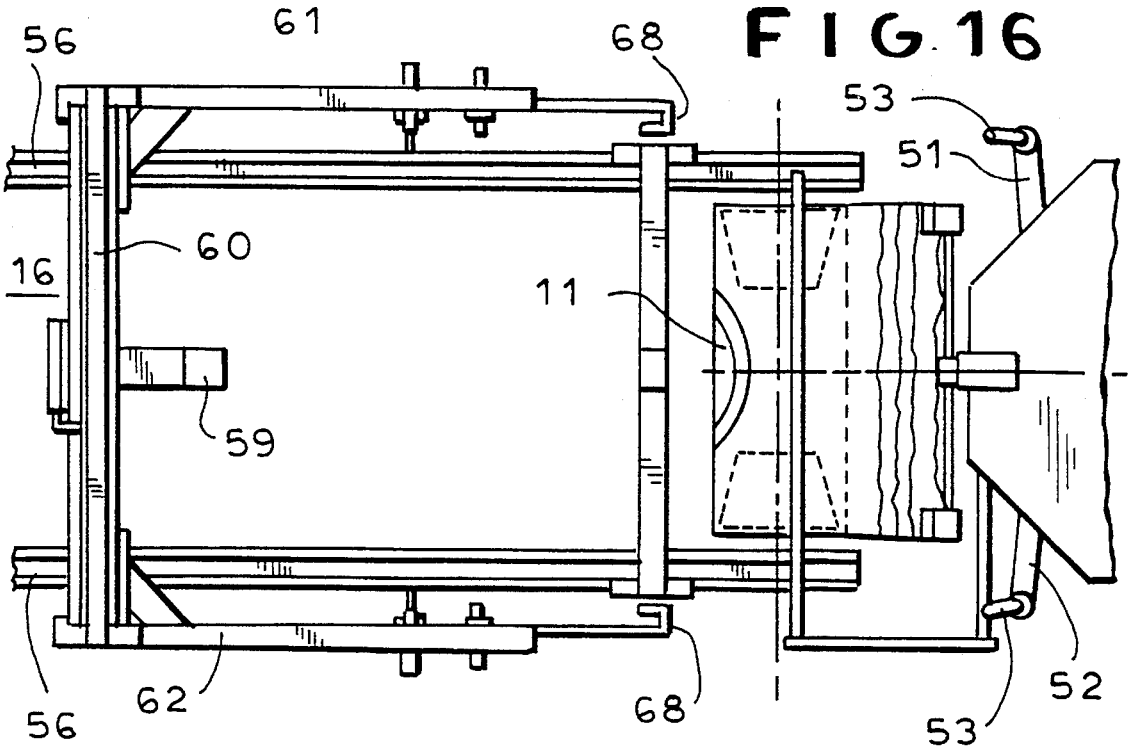
FIGS. 16 and 17 are fragmentary top and elevational views, respectively, illustrating features of the unload station of the system.
Figure 17:
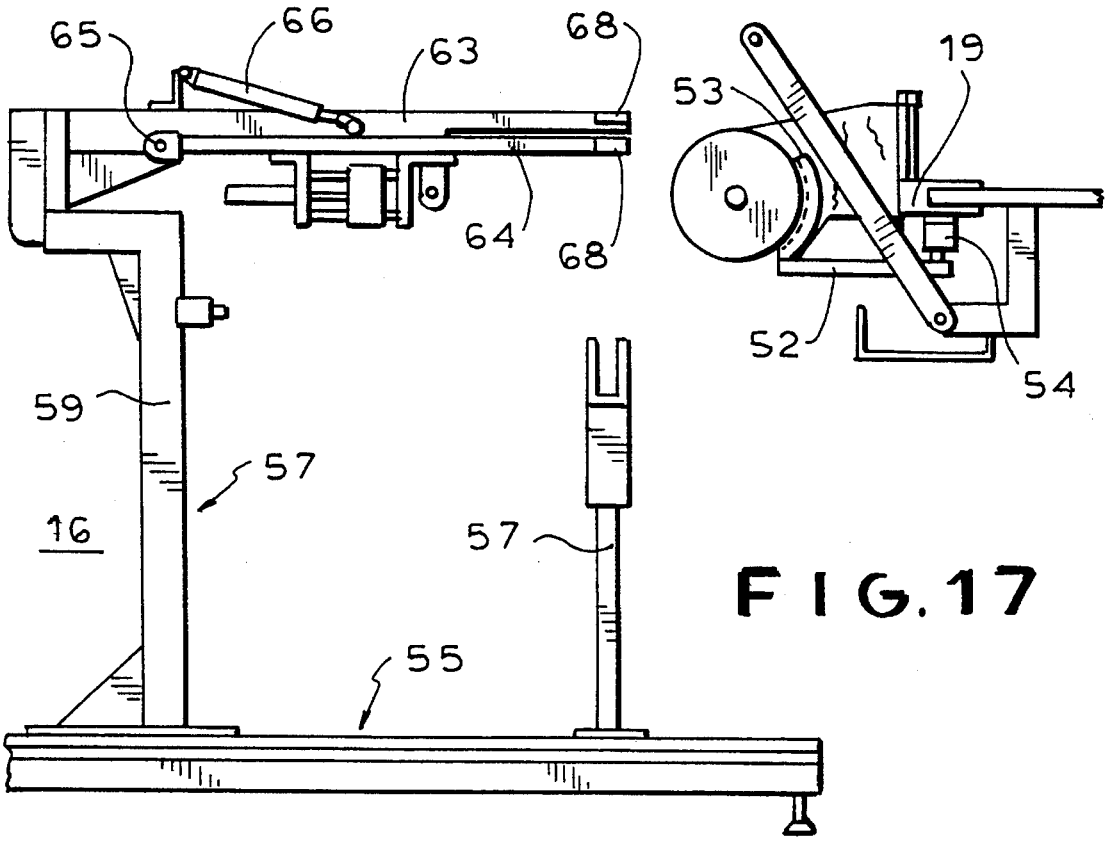

Prior to starting the unloading operation, the telescoping cross bar 60 is extended, so that the extracting arm assemblies 61, 62 are separated to a width wider than the load fixture 11 (see FIG. 16). By means of a fluid cylinder or other actuating means, the support 59 is advanced toward the load fixture, so that the respective extracting arm assemblies 61, 62 straddle the load fixture in the manner shown in FIG. 18. When the support 59 reaches its extended position, shown in FIG. 18, the extracting hooks 68, 69 are located slightly beyond the open end of the tubular shirt body. In addition, shoulder gripping elements 70, 71, carried by the respective fixed extracting arms 63, are aligned with an edge of the load fixture 11. When this position is reached, the telescoping cross bar 60 is retracted, closing the extracting arm assemblies 61, 62 until position sensors 72, 73, carried by the respective extracting arm assemblies 61, 62, engage the load fixture and cause the closing movement to be discontinued. In this position, shown in FIG. 18, the extracting hooks 68, 69 are in position to engage the tail of the tubular shirt body, just below the upper clips 34. The grippers 70, 71 engage the shirt material in the area of the shoulder and are actuated to pull outwardly on the shoulder at each side to free up the sleeve sections and facilitate the subsequent removal of the shirt body from the load fixture.

In conjunction with this operation, the movable lower extracting arms 64 are pivoted downward, to a position shown in FIG. 19, with the hooks 69 engaged with the shirt material, drawing the open tail of the shirt to a position below the cylindrical body shell sections 29, 30. Simultaneously, the telescoping cross bar 60 is extended to separate the extracting arm assemblies 61, 62 to positions shown in FIG. 20. Thereafter, the support 59 is retracted along the rails 56, away from the turret 10. With the tail of the shirt at this point in the process of being engaged by the hooks 68, 69, the tail portion 72 of the shirt is laterally distended, somewhat as shown in FIG. 20. Since the sleeve and shoulder sections of the shirt initially resist withdrawal from the sleeve cones, the continued retraction of the extracting arms first causes the shirt body to be turned inside-out, and then causes the tubular sleeve sections to be drawn off of the respective sleeve cones 17, 18.

When the partially removed shirt reaches a position somewhat as shown in FIGS. 20 and 21, a sweeper bar 73, mounted on a pivot arm 74, is actuated to swing on an arc passing downward, between the hooks 68, 69 and the body form 11. The sweeper bar moves downwardly toward and, if desired, into contact with the stacking rack 58. This operation completes the removal of the shirt from the body form, and also causes the shirt to be disengaged from the hooks 68, 69, such that the completed shirt is draped over the rack 58, generally as shown at 75 in FIG. 23. The sweeper bar 73 can then be retracted to its normal, upraised position, shown in FIG. 23, and the lower extracting arms 64 are retracted by the actuator 66 to a closed, (horizontal) position in preparation for a subsequent operation.

In one preferred embodiment of the invention, the height of accumulated finished shirts 75 on the rack 58 is monitored by an optical sensor 76 such that, when the stack of accumulated completed shirts reaches a predetermined height, the operator is alerted to clear the stack.

Figure 24:
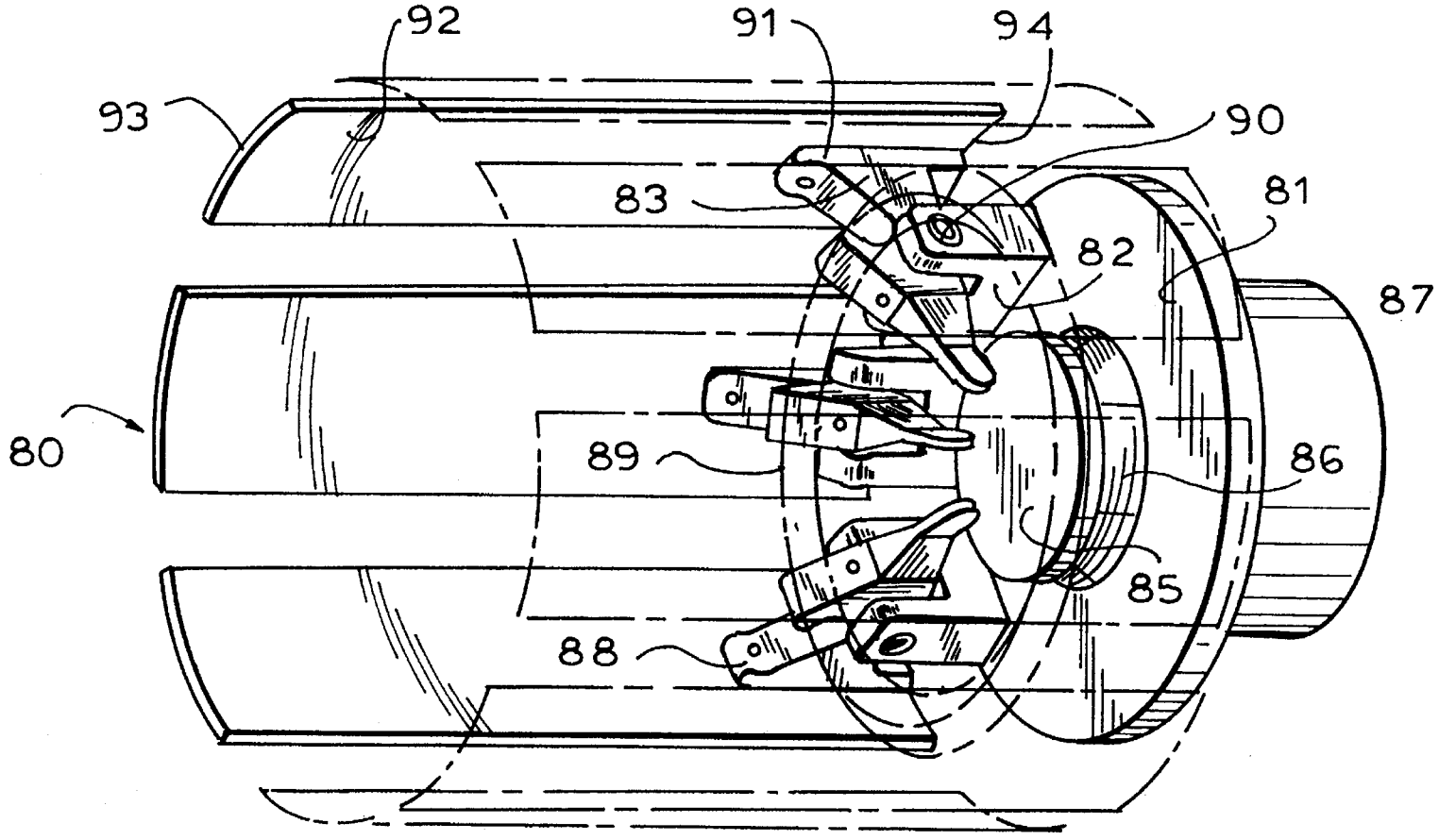
FIGS. 24, 25 are perspective illustrations of a modified form of sleeve cone mechanism which can be employed in the apparatus of the invention, particularly for the processing of long-sleeved shirts, FIG. 24 illustrating the sleeve cone in its normal operating configuration and FIG. 25 illustrating the modified cone in a collapsed configuration to facilitate loading.
Figure 25:
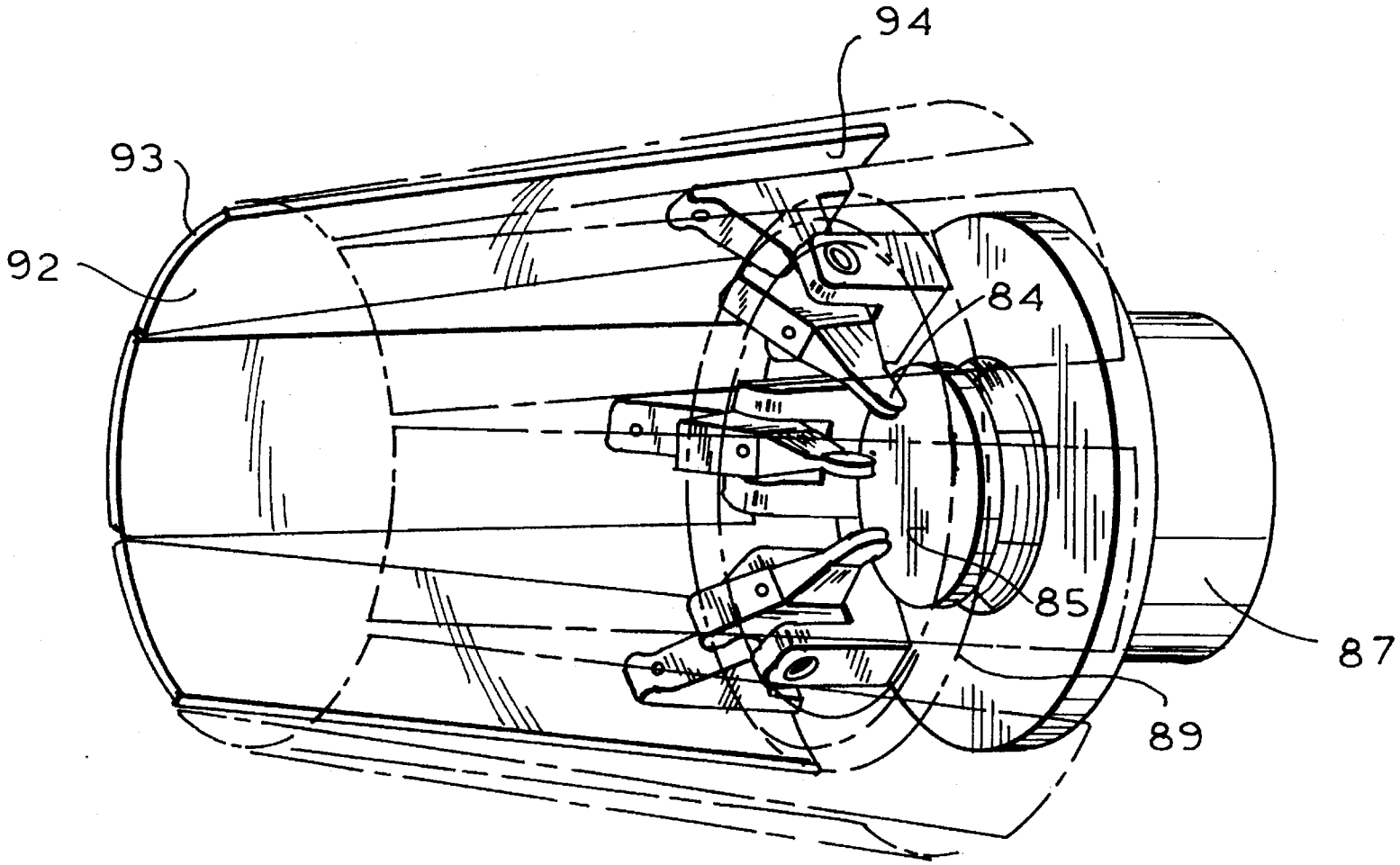

In a modified form of the invention, shown in FIGS. 24 and 25, sleeve cones 80 are of segmented, collapsible construction to facilitate the initial loading of tubular sleeve sections, particularly where long or full length sleeves are utilized. In the representative illustrations of FIGS. 24, 25, the sleeve cones include a circular base member 81 mounting on its outer face a plurality of support brackets 82 arranged in uniformly angularly spaced relation about the outer edge margin. In the illustrated device, there are eight such support brackets spaced apart at 45° intervals.

Each of the support brackets 82 pivotally mounts a positioning lever 83. One end 84 of each positioning lever projects radially inward and bears against the outer face of an anvil disc 85 carried by the rod 86 of an actuating device 87. Each of the positioning levers 83 is formed with an outwardly facing recess 88 arranged for the reception of a contractible circular spring 89. The positioning of the recesses 88 and the circular spring, in relation to the pivot pins 90 by which the positioning levers are mounted, is such that the spring 89 constantly urges the inner ends 84 of the positioning levers toward and into contact with the anvil disc 85. When the anvil disc 85 is retracted, by means of the actuator 87, all of the positioning levers 83 rotate simultaneously, under the influence of the spring 89 to maintain the inner ends 84 in contact with the anvil disc. When the actuator 87 is extended, the positioning levers are simultaneously pivoted in the opposite direction.

Attached to outer end portions 91 of the positioning levers are elongated arcuate sleeve cone sections 92, which can be segments of a cylinder or, preferably, segments of a frusto-conical form. Collectively, a plurality of the arcuate segments 92, mounted on the positioning levers 83, define a support surface of a sleeve cone, for the reception of a tubular sleeve element.

When the actuator 87 is extended, the positioning levers 83 preferably are pivoted to a position in which the outer ends 93 of the arcuate segments 92 are at a slightly larger diameter than the inner ends 94, such that the sleeve cone assumes a slightly frusto-conical form, with its larger end outward.

When the actuator 87 is retracted, the outer ends 93 of the arcuate segments are tilted inward, by the action of the circular spring 89, such that the sleeve cone assumes a frusto-conical configuration of opposite orientation. That is, the outer ends 93 of the arcuate segments 92 form a smaller diameter circle than the inner ends 94, substantially as illustrated in FIG. 25. This arrangement particularly facilitates the loading of elongated sleeve sections onto the sleeve cone, where there is considerable fabric to be gathered over the length of the sleeve cone, during the sleeve loading operation.

Figure 26:
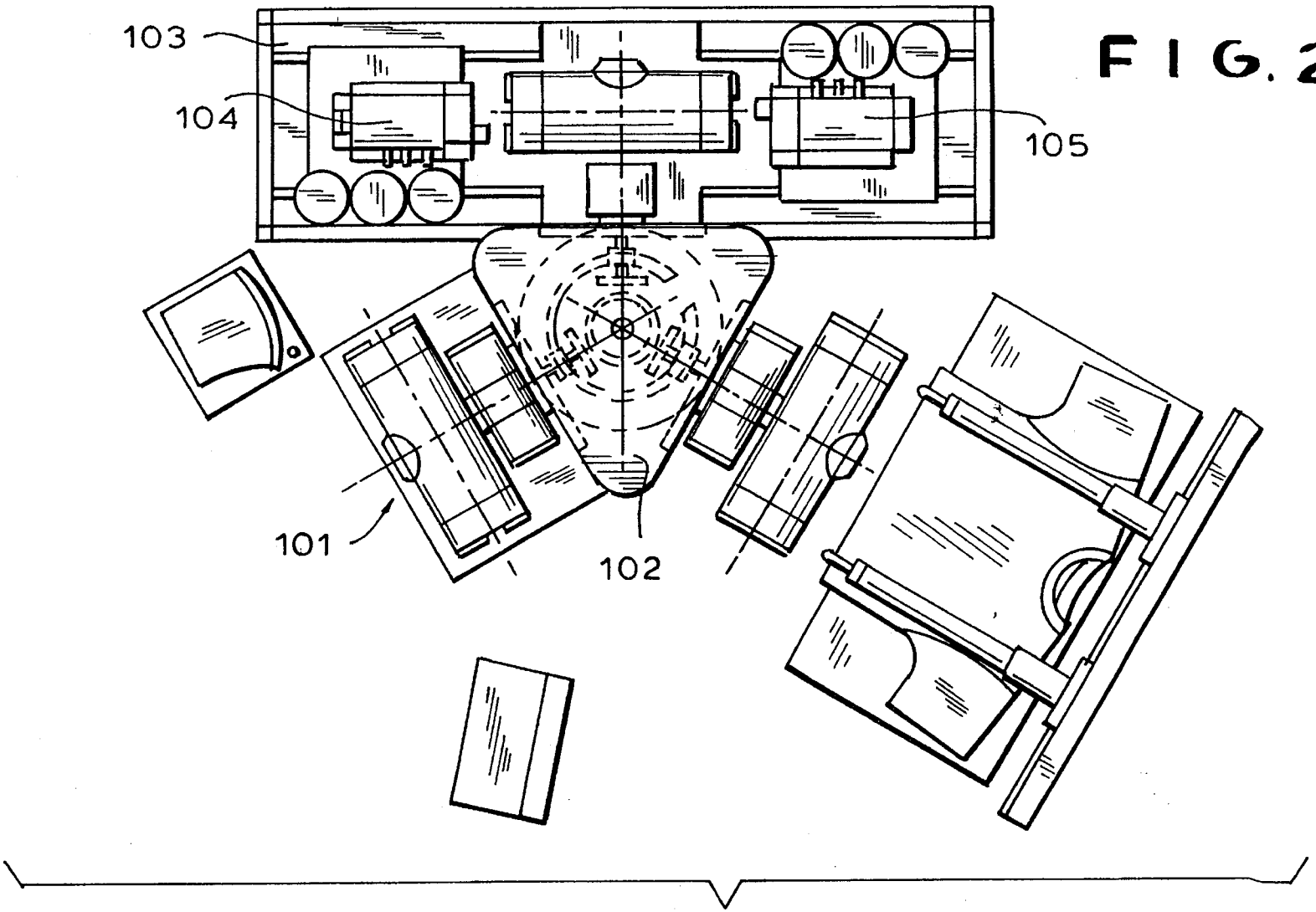
FIG. 26 is a simplified, top plan view of a three-station turret apparatus forming another embodiment of the invention.

With reference to FIG. 26, there is shown a three-station turret system, similar in principle to that shown in FIG. 1, but incorporating a sewing station at which both shoulder seams are sewn simultaneously. Thus, the body and sleeve sections are loaded in the manner herein described at a load station 101. The turret 102 is then indexed to bring the load fixture into alignment with a dual sewing station 103 mounting sewing machines 104, 105 in positions adjacent the opposite ends of the load fixture. During the indexing of the turret, the sewing station 103 is retracted sufficiently to accommodate the rotary indexing of the turret and its load fixtures, after which the sewing station advances toward the turret to bring the sewing machines 104, 105 into working alignment. Alternatively, the sewing station may be arranged so that the sewing machines 104, 105 are mounted at a fixed distance from the turret, far enough to accommodate indexing movements, and the elements of the lathe may be arranged to advance radially inward to pick up the load fixture from the turret and carry it back to a position aligned with the sewing machines. The last described arrangement has an advantage in the fact that the mass of the two sewing machines is not involved in the radial in and out movements while the lathe engages the load fixture, detaches it from the turret and retracts it radially for the sewing operations.

Ideally, in the system according to FIG. 26, the sewing machines 104, 105 are designed for operation in opposite directions. Sewing machines that run in the opposite direction from standard are capable of manufacture and operation, but are not readily available commercially, because of lack of demand for them. As and when the reverse direction sewing machines become readily commercially available, the system of FIG. 6 would employ one standard and one "reverse" machine, enabling the two opposite side seams to be sewn simultaneously.

An alternative to the use of a "reverse" machine at one end in the FIG. 26 system, is the use of standard sewing machines at both ends, rotating the lathe in one direction for the sewing of the seam at one end, and in the opposite direction for the sewing of a seam at the opposite end.

The system of the invention, while relatively simplified in comparison to prior equipment for the purpose, provides for expedited and efficient loading of workpieces, as well as for significant efficiency in the sewing and stacking operations. The loading operation is enhanced by provision of a retractable body shell which, except during sewing operations, completely surrounds sleeve cone members carrying tubular sleeve sections. The retractable shell sections open up to facilitate the actions involved in loading of the sleeve sections, and then close over the loaded sleeve cones, effectively isolating the loaded sleeve sections until the sewing operations are commenced.

A particularly advantageous feature of the invention resides in the provision of axially retractable sleeve shields carried by the body shell. After loading of the sleeve sections and closing of the body shell therearound, the outer (shoulder) edges of the sleeve sections are completely protected by the axially extended sleeve shields. This allows subsequent loading of a shirt body section over the body form and around the previously loaded sleeve sections, without disturbing the sleeve sections or the alignment of the edges thereof. When the sewing operations are commenced, the sleeve shields are axially retracted so that the shoulder margins of the sleeve sections are accessible to the sewing machine for the sewing operation.

In one advantageous form of the invention, the sleeve cones are mounted for pivoting motion such that, at the loading station, the sleeve cones may be pivoted 90° and presented end-on to the operator for easy, efficient loading. After loading, the sleeve cones are pivoted back to their normal positions, in axial alignment at opposite ends of the body form. It is also possible, with the system of the invention, to mount the sleeve cones in fixed, axially aligned positions, inasmuch as the retractable body form arrangement of a shell arrangement provides convenient access to such sleeve cones to facilitate loading of sleeve sections thereon.

Another unique and advantageous feature of the invention is the detachable mounting of the load fixtures 11 on the central turret apparatus. This novel arrangement enables the entire load fixture to be separated from the turret and bodily rotated relative to fixed sewing machines, in order to effect sewing of the sleeve sections to body sections. In as much as the load fixtures have significantly less mass than a complete sewing apparatus, manipulation of the load fixture relative to the sewing machine has significant advantages over the alternative of manipulating the sewing machine relative to a fixed body form.

In the system of the invention, it is advantageous to provide two separate sewing stations, with one shoulder seam being processed at each station, as this simplifies the mounting and manipulation of the load fixture. If necessary, however, both shoulder seams could be processed at a single sewing station.

In the latter case, an optimum system will utilize a standard and a "reverse" sewing machine at opposite ends of the load fixture. Alternatively, standard sewing machines can be used at both ends, with the load fixture being rotated first in one direction to sew one seam and in the other direction to sew the other seam.

In the system of the invention, the shirt body is loaded onto the body form in an "inside-out" orientation. At the unload station, the open tail of the shirt is engaged and drawn outwardly over the body form, which simultaneously removes the processed shirt from the body form and reorients the finished shirt to an "outside-out" orientation.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. Apparatus for assembling and sewing sleeve sections to shirt bodies, which comprises (a) a load fixture comprising a body form and a pair of sleeve cones, (b) said sleeve cones being adapted for the loading thereon of tubular sleeve sections in outside-out orientation, (c) said body form having a hollow interior including generally cylindrical shoulder-forming portions for receiving said sleeve cones internally at each end with said cones arranged in spaced apart relation and aligned substantially on a common axis, and having an exterior for supporting shoulder areas of a shirt body in inside-out orientation and in surrounding relation to said-sleeve sections, (d) sewing means engageable with said sleeve sections and said shirt body for securing said sleeve sections to said shirt body while said shirt body is supported by said body form and said sleeve sections are supported by said sleeve cones, and (e) means for supporting said sleeve cones within said body form during operation of said sewing means.

2. An apparatus according to claim 1, wherein (a) said body form comprises first and second body shell sections, and (b) at least one of said body shell sections is mounted for retractable movement to open the interior of said body form to accommodate the reception of and/or access to said sleeve cones, (c) said at least one body shell section being closed and in surrounding relation to said sleeve cones during operation of said sewing means.

3. An apparatus according to claim 1, wherein (a) outer end shield portions of each of said shoulder-forming portions are controllably projectable axially over outside end portions of said sleeve cones for loading of a shirt body in surrounding relation to previously loaded sleeve cones, and (b) said shield portions are controllably retractable axially within said body shell sections to enable access to ends of said sleeve sections for sewing.

4. An apparatus according to claim 1, wherein (a) said apparatus includes a plurality of said load fixtures and a carrier for progressively advancing said load fixture to successive working stations for loading, sewing and unloading operations, (b) said load fixtures being detachably coupled with said carrier, (c) a sewing apparatus located at one of said working stations, and (d) means at said one working station for engaging and supporting a detached load fixture and for rotating said load fixture about said common axis during operation of said sewing apparatus.

5. Apparatus for assembling and sewing sleeve sections to shirt bodies, which comprises (a) a load fixture comprising a body form and a pair of sleeve cones, (b) means mounting said sleeve cones with said cones arranged in spaced apart relation aligned substantially on a common axis for retaining tubular sleeve sections loaded on said sleeve cones in an outside-out orientation, (c) a shirt body form surrounding and enclosing said sleeve cones and arranged to receive a shirt body in an inside-out orientation and in surrounding relation to said sleeve cones and sleeve sections loaded thereon, and (d) sewing means engageable with shoulder end margins of said sleeve sections and shoulder margins of said shirt body while said shirt body is supported by said body form and said sleeve sections are supported by said sleeve cones for securing said sleeve sections to said shirt body.

6. An apparatus according to claim 5, wherein (a) said body form comprises first and second semi-cylindrical body shells, (b) at least one of said body shells being movable between open and closed positions, (c) said body shells, when in closed positions, substantially surrounding and enclosing said sleeve cones.

7. Apparatus for assembling and sewing sleeve sections to shirt bodies, which comprises (a) a plurality of load fixtures, each comprising means for supporting tubular sleeve sections and a shirt body in aligned relation for sewing of said sleeve sections onto said shirt body, (b) a carrier for supporting said load fixtures and advancing said load fixtures successively between work stations for effecting loading, sewing and unloading operations, (c) coupling means for detachably coupling said load fixtures to said carrier, (d) rotary support means at one of said work stations for engaging and supporting a load fixture detached from said carrier, (e) said rotary support means including means for controllably rotating said detached load fixture about an axis of at least one of said tubular sleeve sections, (f) sewing apparatus movable to a position adjacent at least one end of said detached load fixture for effecting sewing of a sleeve section to a shirt body during rotation of said detached load fixture.

8. An apparatus according to claim 7, wherein (a) said work stations including at least one sewing station, (b) a platform at said sewing station movable toward and away from said carrier, (c) said rotary support means comprising spaced apart rotary supports mounted on said platform and engageable with opposite ends of a load fixture to support said load fixture after detachment from said carrier, (d) a controllable rotary drive on one of said rotary supports, (e) said sewing apparatus including a sewing machine adjacent the other of said rotary supports and movable toward an end of said detached load fixture and into sewing engagement with an aligned sleeve section and shirt body supported on said detached load fixture.

9. An apparatus according to claim 8, wherein (a) said controllable rotary drive is synchronized with said sewing machine whereby rotation of said load fixture causes controlled linear advancement of portions of said sleeve section and shirt body past said sewing machine during sewing.

10. An apparatus according to claim 8, wherein (a) said apparatus includes two sewing stations, for sewing opposite side sleeve sections to a shirt body in separate operations at separate work stations.

11. An apparatus according to claim 8, wherein (a) said apparatus includes a single sewing station, (b) said sewing station including a pair of spaced-apart sewing machines adapted for operational engagement with opposite ends of a load fixture.

12. A load fixture for use in an apparatus for assembling and sewing tubular sleeve sections and shirt bodies, and which includes a body form for supporting said sleeve sections and said shirt bodies, wherein said body form comprises, (a) a central support member, (b) a pair of sleeve supports mounted on said central support for movement between sewing positions, in which said sleeve supports are aligned along a common axis, and load positions, in which said sleeve supports are pivoted at a substantial angle to said common axis for end-on presentation to a machine operator.

13. A load fixture according to claim 12, wherein (a) said body form includes a hollow body shell substantially surrounding and enclosing said sleeve supports when said supports are in said sewing position.

14. A load fixture according to claim 12, wherein (a) said hollow body shell comprises upper and lower semi-cylindrical body shell members, and (b) at least one of said body shell members is retractable to accommodate pivoting movement of said sleeve supports between sewing and load positions.

15. In an apparatus for assembling and sewing sleeve sections to shirt bodies, and which comprises a plurality of work stations, a plurality of load fixtures for supporting tubular sleeve sections and shirt bodies in aligned relation for sewing of the sleeve sections to the shirt bodies, a carrier for moving said load fixtures to successive work stations, and unloading means at an unloading station for unloading completed shirts from said load fixtures, the improvement characterized by (a) said load fixtures being arranged to orient shirt bodies inside-out and with tail portions of said shirt bodies extending toward said carrier, (b) said unloading means comprising spaced apart extracting arms extending toward a load fixture positioned at said unloading station, in straddling relation to said load fixture, (c) means mounting said spaced apart extracting arms for controlled movement toward and away from each other, (d) means for controllably moving said extracting arms toward and away from said carrier, whereby said arms, when spaced apart and straddling a load fixture, are extendable to a position adjacent to said tail and thereafter, having being moved toward each other, are engageable with said tail, and (e) means for controllably retracting said extracting arms after engagement thereof with said tail, whereby said shirt body is simultaneously withdrawn from said load fixture and turned to a right-side-out orientation.

16. An improvement according to claim 15, wherein (a) said extracting arms are comprised a pair of arms, upper and lower, at each side, (b) at least a first arm of each pair thereof being pivotally mounted for movement of its free end from a first position close to a second arm of each pair to a second position spaced vertically from said second arm, (c) each arm of each pair being engaged with a portion of the tail of a shirt body to facilitate withdrawal of said shirt body over said load fixture.

17. An improvement according to claim 16, wherein (a) said load fixture includes a pair of spaced-apart tail receiving clips for retaining portions of the tail of a shirt body in spaced apart relation to facilitate engagement of said tail by said extracting arms.

18. An improvement according to claim 15, wherein (a) said unloading station includes a sweep arm mounted at said unloading station for controlled vertical movement from a first position above said load fixture to a second position substantially below said first position, and (b) means to actuate said sweep arm after said extracting arms have been retracted to a position spaced from said load fixture.

19. An apparatus for assembling and sewing sleeve sections to shirt bodies, which comprises (a) a plurality of load fixtures each comprising a pair of sleeve cones and a body shell, (b) a carrier for advancing said load fixtures to successive work stations, including a load station, at least one sewing station and an unload station, (c) said body shell being adapted to be positioned in at least partially surrounding relation to said sleeve cones to receive a shirt body section in an inside-out orientation, (d) said sleeve cones comprising a plurality of elongated arcuate segments movably mounted about a sleeve cone axis and having portions movable radially with respect to said axis to controllably configure said sleeve cones for loading of tubular sleeve sections thereon in an outside-out orientation for reception internally of said body shell.

20. An apparatus according to claim 19, wherein (a) said sleeve cones each comprise a base member, (b) a plurality positioning levers pivotally mounted on said base member and each mounting an arcuate segment for controlled tilting movement with respect to said sleeve cone axis.

21. Apparatus for assembling and sewing sleeve sections to shirt bodies, which comprises (a) a load fixture comprising a body form and a pair of sleeve cones, (b) means mounting said sleeve cones with said cones arranged in spaced apart relation aligned substantially on a common axis for retaining tubular sleeve sections loaded on said sleeve cones, (c) a shirt body form surrounding and enclosing said sleeve cones and arranged to receive a shirt body in surrounding relation to said sleeve cones and sleeve sections loaded thereon, and (d) sewing means engageable with shoulder end margins of said sleeve sections and shoulder margins of said shirt body for securing said sleeve sections to said shirt body while said body and said sections are mounted by said load fixture, (e) said body form comprising first and second semi-cylindrical body shells, (f) at least one of said body shells being movable between open and closed positions, (g) said body shells, when in closed positions, substantially surrounding and enclosing said sleeve cones, (h) said body shells comprising axially extendable-retractable sleeve shields arranged when extended to substantially completely enclose and protect outer edge margins of tubular sleeve sections loaded on said sleeve cones, (i) said sleeve shields being axially retractable for sewing operations to provide access to said outer edge margins, (j) said fixture including clip elements, spaced from said body form for engaging and releasably retaining a tail portion of a shirt body.

22. A load fixture according to claim 21, wherein (a) said clip elements include a pair of spaced-apart upper clips and one or more lower clips spaced below said upper clips.

23. Apparatus for assembling and sewing sleeve sections to shirt bodies, which comprises (a) a load fixture comprising a body form and a pair of sleeve cones, (b) means mounting said sleeve cones with said cones arranged in spaced apart relation aligned substantially on a common axis for retaining tubular sleeve sections loaded on said sleeve cones, (c) a shirt body form surrounding and enclosing said sleeve cones and arranged to receive a shirt body in surrounding relation to said sleeve cones and sleeve sections loaded thereon, and (d) sewing means engageable with shoulder end margins of said sleeve sections and shoulder margins of said shirt body while said shirt body is supported by said body form and said sleeve sections are supported by said sleeve cones for securing said sleeve sections to said shirt body, (e) said body form comprising first and second semi-cylindrical body shells, (f) at least one of said body shells being movable between open and closed positions, (g) said body shells, when in closed positions, substantially surrounding and enclosing said sleeve cones, (h) said body shells comprising axially extendable-retractable sleeve shields arranged when extended to substantially completely enclose and protect outer edge margins of tubular sleeve sections loaded on said sleeve cones, (i) said sleeve shields being axially retractable for sewing operations to provide access to said outer edge margins, while said sleeve sections remain supported on said sleeve cones.

24. An apparatus for assembling and sewing sleeve sections to shirt bodies, which comprises (a) a plurality of load fixtures each comprising a pair of sleeve cones and a body shell, (b) a carrier for advancing said load fixtures to successive work stations, including a load station, at least one sewing station and an unload station, (c) said body shell being adapted to be positioned in at least partially surrounding relation to said sleeve cones, (d) said sleeve cones comprising a plurality of elongated arcuate segments movably mounted about a sleeve cone axis and having portions movable radially with respect to said axis to controllably configure said sleeve cones for loading of tubular sleeve sections thereon, (e) said sleeve cones each comprising a base member, (f) a plurality positioning levers pivotally mounted on said base member and each mounting an arcuate segment for controlled tilting movement with respect to said sleeve cone axis, and (g) actuating means engaging each of said positioning levers for causing said levers to pivot alternatively in first and second directions.

25. An apparatus according to claim 24, wherein (a) said actuator means comprises an anvil disc disposed axially within each of said sleeve cones, (b) end portions of each of said positioning levers extend radially inward with respect to said sleeve cone axis and overlie said anvil disc, and (c) spring means urges said positioning levers into contact with said anvil disc.

* * * * *